US005650203A

United States Patent [19]

Gehlke

[11] Patent Number: 5,650,203

[45] Date of Patent: Jul. 22, 1997

[54] SILICON ION EMITTER ELECTRODES

[75] Inventor: Scott Gehlke, Berkeley, Calif.

[73] Assignee: Ion Systems, Inc., Berkeley, Calif.

[21] Appl. No.: 506,536

[22] Filed: Jul. 25, 1995

Related U.S. Application Data

[63] Continuation of Ser. No. 314,535, Sep. 28, 1994, Pat. No. 5,447,763, which is a continuation of Ser. No. 753,239, Aug. 30, 1991, abandoned.

[51] Int. Cl.[6] ..... H01J 27/00

[52] U.S. Cl. ..... 428/34.1; 428/641; 313/311; 313/633; 250/423 R; 250/424; 72/334; 72/342.2; 29/557

[58] Field of Search ..... 428/544, 620, 428/641, 34.1, 923; 313/325, 310, 311, 346 R, 336, 556, 633, 362.1; 29/557; 252/181.6, 500, 512, 578; 423/324, 348; 250/423 R, 424; 204/292; 136/258 PC, 25 J; 72/334, 342.2

[56] References Cited

U.S. PATENT DOCUMENTS

| | | | |
|---|---|---|---|
| 3,134,906 | 5/1964 | Henker | 250/211 |
| 4,647,348 | 3/1987 | Yamakita | 204/59 R |
| 5,447,763 | 9/1995 | Gehlke | 428/34.1 |

OTHER PUBLICATIONS

Sakurai, T., et al., "Field Calibration Using The Energy distribution of a Free–Space Field Ionization", Journal of Applied Physics, vol. 48, No. 6, Jun. 1977, pp. 2618–2625.

*Primary Examiner*—Charles Nold

*Attorney, Agent, or Firm*—Albert C. Smith; Christopher M. Tobin

[57] ABSTRACT

The present invention relates to ion emitter tip metals and alloys for ionizing the molecules of a gas which concurrently produces small diameter and very low numbers of unwanted particles. Specifically, the invention discloses ion emitter tip materials which, when subjected to normal operating electrical conditions of between about 0.1 and 100 microamperes per emitter tip, produces about 1 particle or less having a diameter of about 0.5 microns or less per cubic foot. Useful ion emitter tip materials include zirconium, titanium, molybdenum, tantalum, rhenium or alloys of these metals. In a specific embodiment, the metal alloys comprise zirconium and rhenium, titanium and rhenium, molybdenum and rhenium, or tantalum and rhenium. Silicon coated metal emitter tips, particularly titanium-silicon coated are disclosed. The emitter tip materials are useful to obtain Class 1 clean room standards in static air or flowing air environments used, for example, in semiconductor manufacture. A preferred ion emitter tip is of silicon of 99.99% plus purity, optionally containing a dopant of phosphorus, boron or antimony. The emitter tip is has a cone/cylinder shape.

10 Claims, 24 Drawing Sheets

TUNGSTEN - 2% THORIUM NEEDLE - FLOW CHAMBER

TUNGSTEN-2% THORIUM NEEDLES-STATIC CHAMBER

TUNGSTEN-2% THORIUM-FILAMENT-FLOW CHAMBER

PLATINUM WIRE - STATIC CHAMBER

TITANIUM WIRE-STATIC CHAMBER

TITANIUM WIRE-FLOW CHAMBER

ZIRCONIUM FILAMENT-STATIC CHAMBER

ZIRCONIUM FILAMENT-FLOW CHAMBER

STARTING TIME (Min) ..... 2.0
MINIMUM (Part / CuFt) ..... 0.0E + 00
AVERAGE (Part / CuFt) ..... 7.7E + 00
MEDIAN (Part / CuFt) ..... 2.5E - 01
SKEWNESS ..... 8.4
NUMBER OF SAMPLES ..... 3298.0

ENDING TIME (Min) ..... 6624.9
MAXIMUM (Part / CuFt) ..... 4.0E + 02
STD. DEV. (Part / CUFt) ..... 2.8E + 01
MODE (PART / CuFt) ..... 2.5E - 01
KURTOSIS ..... 85.0
BIN SIZE (Part / CuFt) ..... 5.0E - 01

PERCENTILES:

| | 10% | 20% | 30% | 40% | 50% | 60% | 70% | 80% | 90% |
|---|---|---|---|---|---|---|---|---|---|
| PART / CuFt | 3E - 01 | 3E - 01 | 3E - 01 | 3E - 01 | 3E - 01 | 3E - 01 | 1E + 01 | 1E + 01 | 1E + 01 |

STARTING TIME (Min) ..... 2.0
MINIMUM (Part / CuFt) ..... 0.0E + 00
AVERAGE (Part / CuFt) ..... 2.6E + 03
MEDIAN (Part / CuFt) ..... 2.0E + 03
SKEWNESS ..... 8.5
NUMBER OF SAMPLES ..... 1704.0

ENDING TIME (Min) ..... 3421.3
MAXIMUM (Part / CuFt) ..... 5.8E + 04
STD. DEV. (Part / CUFt) ..... 4.8E + 03
MODE (PART / CuFt) ..... 2.0E + 03
KURTOSIS ..... 84.7
BIN SIZE (Part / CuFt) ..... 5.0E + 01

PERCENTILES:

| PART / CuFt | 10% | 20% | 30% | 40% | 50% | 60% | 70% | 80% | 90% |
|---|---|---|---|---|---|---|---|---|---|
| 4E + 02 | 8E + 02 | 1E + 03 | 2E + 03 | 2E + 03 | 2E + 03 | 3E + 03 | 3E + 03 | 4E + 03 | |

STARTING TIME (Min) ..... 2.0
MINIMUM (Part / CuFt) ..... 0.0E + 00
AVERAGE (Part / CuFt) ..... 1.7E + 00
MEDIAN (Part / CuFt) ..... 2.5E - 01
SKEWNESS ..... 5.3
NUMBER OF SAMPLES ..... 5069.0

ENDING TIME (Min) ..... 10182.2
MAXIMUM (Part / CuFt) ..... 9.9E + 01
STD. DEV. (Part / CUFt) ..... 4.8E + 00
MODE (PART / CuFt) ..... 2.5E - 01
KURTOSIS ..... 62.6
BIN SIZE (Part / CuFt) ..... 5.0E - 01

PERCENTILES: 10% 20% 30% 40% 50% 60% 70% 80% 90%
PART / CuFt 3E - 01 3E - 01 3E -01 3E - 01 3E - 01 3E -01 3E - 01 3E - 01 1E + 01

STARTING TIME (Min) ..... 2.0
MINIMUM (Part / CuFt) ..... 0.0E + 00
AVERAGE (Part / CuFt) ..... 2.4E + 00
MEDIAN (Part / CuFt) ..... 2.5E - 01
SKEWNESS ..... 6.1
NUMBER OF SAMPLES ..... 4995.0

ENDING TIME (Min) ..... 10037.2
MAXIMUM (Part / CuFt) ..... 1.1E + 02
STD. DEV. (Part / CUFt) ..... 8.2E + 00
MODE (PART / CuFt) ..... 2.5E - 01
KURTOSIS ..... 53.2
BIN SIZE (Part / CuFt) ..... 5.0E - 01

PERCENTILES: 10% 20% 30% 40% 50% 60% 70% 80% 90%
PART / CuFt 3E - 01 3E -01 3E - 01 3E - 01 3E - 01 3E - 01 3E - 01 3E - 01 1E + 01

STARTING TIME (Min) ..... 2.0
MINIMUM (Part / CuFt) ..... 0.0E + 00
AVERAGE (Part / CuFt) ..... 3.9E + 00
MEDIAN (Part / CuFt) ..... 2.5E - 01
SKEWNESS ..... 6.6
NUMBER OF SAMPLES ..... 4012.0

ENDING TIME (Min) ..... 8062.3
MAXIMUM (Part / CuFt) ..... 2.1E + 02
STD. DEV. (Part / CUFt) ..... 1.5E + 01
MODE (PART / CuFt) ..... 2.5E - 01
KURTOSIS ..... 56.8
BIN SIZE (Part / CuFt) ..... 5.0E - 01

PERCENTILES: 10% 20% 30% 40% 50% 60% 70% 80% 90%.
PART / CuFt 3E - 01 3E - 01 3E - 01 3E - 01 3E - 01 3E - 01 3E - 01 3E - 01 1E + 01

STARTING TIME (Min) ..... 2.0
MINIMUM (Part / CuFt) ..... 0.0E + 00
AVERAGE (Part / CuFt) ..... 1.7E + 00
MEDIAN (Part / CuFt) ..... 2.5E - 01
SKEWNESS ..... 5.3
NUMBER OF SAMPLES ..... 5069.0

ENDING TIME (Min) ..... 10182.2
MAXIMUM (Part / CuFt) ..... 9.9E + 01
STD. DEV. (Part / CUFt) ..... 4.8E + 00
MODE (PART / CuFt) ..... 2.5E - 01
KURTOSIS ..... 62.6
BIN SIZE (Part / CuFt) ..... 5.0E - 01

PERCENTILES: 10% 20% 30% 40% 50% 60% 70% 80% 90%
PART / CuFt 3E - 01 3E - 01 3E - 01 3E - 01 3E - 01 3E - 01 3E - 01 3E - 01 1E + 01

STARTING TIME (Min) ..... 2.0
MINIMUM (Part / CuFt) ..... 0.0E + 00
AVERAGE (Part / CuFt) ..... 5.9E + 01
MEDIAN (Part / CuFt) ..... 5.3E + 01
SKEWNESS ..... 9.0
NUMBER OF SAMPLES ..... 3981.0

ENDING TIME (Min) ..... 7999.8
MAXIMUM (Part / CuFt) ..... 1.5E + 03
STD. DEV. (Part / CUFt) ..... 6.7E + 01
MODE (PART / CuFt) ..... 4.3E + 01
KURTOSIS ..... 140.9
BIN SIZE (Part / CuFt) ..... 5.0E + 00

PERCENTILES: 10% 20% 30% 40% 50% 60% 70% 80% 90%
PART / CuFt 1E + 01 2E + 01 3E + 01 4E + 01 5E + 01 6E + 01 7E + 01 8E + 01 1E + 02

STARTING TIME (Min) ..... 2.0
MINIMUM (Part / CuFt) ..... 0.0E + 00
AVERAGE (Part / CuFt) ..... 3.5E + 01
MEDIAN (Part / CuFt) ..... 2.1E + 01
SKEWNESS ..... 4.1
NUMBER OF SAMPLES ..... 5593.0

ENDING TIME (Min) ..... 11235.3
MAXIMUM (Part / CuFt) ..... 6.7E + 02
STD. DEV. (Part / CUFt) ..... 5.2E + 01
MODE (PART / CuFt) ..... 1.1E + 01
KURTOSIS ..... 28.2
BIN SIZE (Part / CuFt) ..... 2.5E + 00

PERCENTILES: 10% 20% 30% 40% 50% 60% 70% 80% 90%
PART / CuFt 1E + 00 1E + 01 1E + 01 1E + 01 2E + 01 2E + 01 3E + 01 5E + 01 8E + 01

STARTING TIME (Min) ..... 2.0
MINIMUM (Part / CuFt) ..... 0.0E + 00
AVERAGE (Part / CuFt) ..... 2.0E + 01
MEDIAN (Part / CuFt) ..... 1.1E + 01
SKEWNESS ..... 3.6
NUMBER OF SAMPLES ..... 4330.0

ENDING TIME (Min) ..... 8701.0
MAXIMUM (Part / CuFt) ..... 4.3E + 02
STD. DEV. (Part / CUFt) ..... 3.8E + 01
MODE (PART / CuFt) ..... 1.3E + 00
KURTOSIS ..... 20.0
BIN SIZE (Part / CuFt) ..... 2.5E + 00

PERCENTILES: 10% 20% 30% 40% 50% 60% 70% 80% 90%
PART / CuFt 1E + 00 1E + 00 1E + 00 1E + 00 1E + 01 1E + 01 2E + 01 2E + 01 5E + 01

Si - ETCHED - NEW HEPA ON

| | | | |
|---|---|---|---|
| STARTING TIME (Min) | 28.2 | ENDING TIME (Min) | 5766.7 |
| MINIMUM (Part / CuFt) | 0.0E + 00 | MAXIMUM (Part / CuFt) | 4.5E + 02 |
| AVERAGE (Part / CuFt) | 3.5E + 00 | STD. DEV. (Part / CUFt) | 1.3E + 01 |
| MEDIAN (Part / CuFt) | 1.3E + 00 | MODE (PART / CuFt) | 1.3E + 00 |
| SKEWNESS | 17.6 | KURTOSIS | 505.4 |
| NUMBER OF SAMPLES | 2854.0 | BIN SIZE (Part / CuFt) | 2.5E + 00 |

| PERCENTILES: | 10% | 20% | 30% | 40% | 50% | 60% | 70% | 80% | 90% |
|---|---|---|---|---|---|---|---|---|---|
| PART / CuFt | 1E + 00 | 1E + 00 | 1E + 00 | 1E + 00 | 1E + 00 | 1E + 00 | 1E + 00 | 1E + 01 | 1E + 01 |

Si - ETCHED ~17000 MIN PRIOR USE HEPA ON TSI .025 SCREENS

| | | | |
|---|---|---|---|
| STARTING TIME (Min) | 20.0 | ENDING TIME (Min) | 8684.3 |
| MINIMUM (Part / CuFt) | 0.0E + 00 | MAXIMUM (Part / CuFt) | 5.0E + 00 |
| AVERAGE (Part / CuFt) | 3.5E - 01 | STD. DEV. (Part / CUFt) | 7.9E - 01 |
| MEDIAN (Part / CuFt) | 1.3E + 00 | MODE (PART / CuFt) | 1.3E + 00 |
| SKEWNESS | 3.0 | KURTOSIS | 13.5 |
| NUMBER OF SAMPLES | 437.0 | BIN SIZE (Part / CuFt) | 2.5E + 00 |

| PERCENTILES: | 10% | 20% | 30% | 40% | 50% | 60% | 70% | 80% | 90% |
|---|---|---|---|---|---|---|---|---|---|
| PART / CuFt | 1E + 00 | 1E + 00 | 1E + 00 | 1E + 00 | 1E + 00 | 1E + 00 | 1E + 00 | 1E + 00 | 1E + 00 |

Si - ETCHED - NEW HEPA ON - TSI SCREEN .025

STARTING TIME (Min) ..... 20.0
MINIMUM (Part / CuFt) ..... 0.0E + 00
AVERAGE (Part / CuFt) ..... 8.8E - 01
MEDIAN (Part / CuFt) ..... 1.3E + 00
SKEWNESS ..... 8.6
NUMBER OF SAMPLES ..... 561.0

ENDING TIME (Min) ..... 11171.3
MAXIMUM (Part / CuFt) ..... 3.3E + 01
STD. DEV. (Part / CUFt) ..... 2.0E + 00
MODE (PART / CuFt) ..... 1.3E + 00
KURTOSIS ..... 125.7
BIN SIZE (Part / CuFt) ..... 2.5E + 00

PERCENTILES: 10% 20% 30% 40% 50% 60% 70% 80% 90%
PART / CuFt 1E + 00 1E + 00 1E + 00 1E + 00 1E + 00 1E + 00 1E + 00 1E + 00 4E + 00

SILICON ION EMITTER ELECTRODES

This is a continuation of copending application Ser. No. 08/314,535 filed on Sep. 28, 1994 now U.S. Pat. No. 5,447,763 which is a continuation of Ser. No. 07/753,239 filed on Aug. 30 1991 abandoned which is a CIP of 01/004, 660 filed on Aug. 17, 1990.

BACKGROUND OF THE INVENTION

1. Origin of the Invention

The present invention is a continuation-in-part application of pending PCT International Application No. WO91/03143 (PCT/US90/04660), filed Aug. 17, 1990, designating the United States. The Chapter II Demand was timely filed on Mar. 15, 1991, also designating the United States. This pending PCT International patent application is incorporated herein by reference in its entirety.

2. Field of the Invention

The present invention discloses a number of ion emitter tip materials, e.g., filaments or needles, which are used to generate gaseous ions, but which concurrently generate undesirable particles of size of 0.5 microns or less. Thin coatings of silicon on the tips are also described. Specifically, these tip materials and coatings; may be used to maintain Class 1 clean room particle conditions usually associated with the manufacture of electronic devices, especially semiconductors.

2. Description of the Related Art

Semiconductor manufacturers and others need to go to great lengths to maintain a clean processing area, and to prevent particle contamination of critical wafer surfaces. Once a particle is airborne, it becomes a potential contaminant whether it comes from a moving machine or from a surface. In either case, it is prudent to eliminate or decrease the source of the particles.

When the particle source cannot be eliminated, steps need to be taken to reduce the deposition of airborne particles on surfaces. One method is to use bipolar air ionization to reduce surfaces on products.

Present reports concerning particle generation by ionizers show a number of problems. Some results are based on accelerated testing at corona currants of up to 50 times normal operating levels. Some tests used emitter materials that ionizer manufacturers do not use because these materials erode rapidly. The air quality in clean rooms is generally classified according to specific standard criteria, relating the class designation to the number of particles per cubic foot of air at a size of about 0.5 microns. Thus Class 1 conditions refer to fewer than 1 particle of 0.5 micron size per cubic foot of air.

Presently Class 1 cleanroom conditions (i.e., 10 particles of 0.5 microns or larger per cubic foot) are achieved using conventionally available emitter materials, e.g. tungsten-2% thorium. In some applications, Class 10 conditions are not clean enough to provide a satisfactory manufacturing environment. Class 1 conditions are needed. Unfortunately, there is presently no way to predict a priori which ion emitter tip materials can be used to produce Class 1 conditions.

West German patent application DE 36 03647 1A describes the use of a number of materials, metals and alloys, as ion emitter tips. Comparative experiments were performed for 1,000 hours at a 10-fold electrical point load. This patent does not disclose the size or amount of particles emitted using normal electrical work load conditions. The patent does not disclose emitter tip materials which are useful to achieve Class 1 conditions.

R. F. Cheney, et el. in U.S. Pat. No. 3,745,000 described a process for producing tungsten-alloy type electrodes. The tungsten is alloyed with from 0.2 to about 7.0 percent by weight of a Group VIII metal additive which lowers the sintering temperature of tungsten at least about 100° C. A tungsten lead is also described consisting essentially of tungsten and from about 1 to 30 percent by weight of rhenium. The patent does not disclose alloy compositions for ion emitter tip materials which are useful to achieve Class 1 conditions.

R. B. Donovan, et al., (May, 1986) *Microcontamination,* p. 38, B. Y. Liu, et el. (1985) "Characterization of Electronic ionizers in the Clean Room," 31st Meeting, institute of Environmental Sciences, Las Vegas, Nev., disclose that ionizer particles emitted typically have a mean count diameter of about 0.03 microns. These particle measurements are obtained with a condensation nucleus counter (CNC) and indicate a qualitative difference in ion particle production based on various emitter tip materials. These two references do not disclose specific ion emitter tip materials useful to achieve Class 1 conditions.

U.S. Patents of general background interest in the ion emitter for the reduction of airborne particle contamination in a clean room includes J. Sachetano, 4,902,640; A. J. Steinman et al., 4,901,194; H. Ooga, et al., 4,725,874; 4,894,253; A. Kawakatsu, 4,873,200; R. W. Barr, 4,739,214; and W. R. Heineman et al. 4,894,253.

All articles, patents, references and standards cited are incorporated herein by reference in their entirety.

It is therefore apparent from the above that a need exists to identify emitter tip materials that would be useful for generating gaseous ions in a manner compatible with Class I particle conditions in clean rooms. The present invention provides a solution to this need, by the use of specific metals and metal alloys as the ion emitter tips and coatings on the emitter tips.

SUMMARY OF THE INVENTION

The present invention relates to an ionization system for ionizing molecules of gas, which concurrently introduces quantities of particles into the gas, said ionization system consisting of an emitter system comprising at least one emitter point and high voltage power supply, wherein said particles have a count mean diameter of 0.5 microns or smaller and one particle or less per cubic foot is present in a static environment or in a flowing air environment.

In one aspect, the ionization system has at least one emitter tip selected from silicon or from metals comprising zirconium, titanium, molybdenum, tantalum, iridium or rhenium or alloys thereof.

In another aspect, the ionization system has at least one emitter tip of zirconium, titanium, molybdenum, tantalum or rhenium, wherein each metal in each emitter tip is present in about 99 percent by weight or greater.

In yet another aspect, the ionization system has at least one emitter tip selected from metal alloys comprising zirconium and rhenium, titanium and rhenium, molybdenum and rhenium, tantalum and rhenium, or tungsten and titanium.

In a preferred embodiment, the ionization system has an emitter tip wherein each metal alloy of zirconium, titanium, molybdenum or tantalum are present in at least 70 percent by weight and rhenium in each alloy is present in between about 1 and 30 percent by weight.

The present invention relates to an ion emitter tip material for ionizing the molecules of a gas, which also produces particles having a count mean diameter of 0.5 microns or less at a concentration of one particle or less per cubic foot at a current of between about 0.1 and 100 microamperes per emitter tip, preferably wherein the current emitter tip is about 2 microamperes.

In another aspect, the present invention relates to silicon emitter tips which are doped with up to 1 part of boron, antimony or phosphorous in 10,000 parts silicon or to the metal or metal alloy tips described herein where the silicon coating at the tip is between 1 and 100 microns in thickness.

DETAILED DESCRIPTION OF THE INVENTION

AND PREFERRED EMBODIMENTS

It is important to have a counting device that can detect these very small particles. A condensation nucleus counter can usually detect particles larger than about 10 nanometers in size. An optical counter can be used to detect larger particle sizes in the 0.1 micron and larger range. However, under most normal operating conditions, the particle counts are so low that they are essentially in the background noise of the optical counter.

A chamber for measuring particles produced by the ion emitter tip materials is described by the present inventor, M. G. Yost, et al. in "Method of Measuring Particles from Air Ionization Equipment" presented at the 35th Annual Technical Meeting of the Institute of Environmental Sciences, Advanced Monitoring Techniques Section, May 3, 1989, and co-pending U.S. patent applications, Ser. No. 346,073 filed May 2, 1989, both of which are specifically incorporated by reference.

Figure 1A:
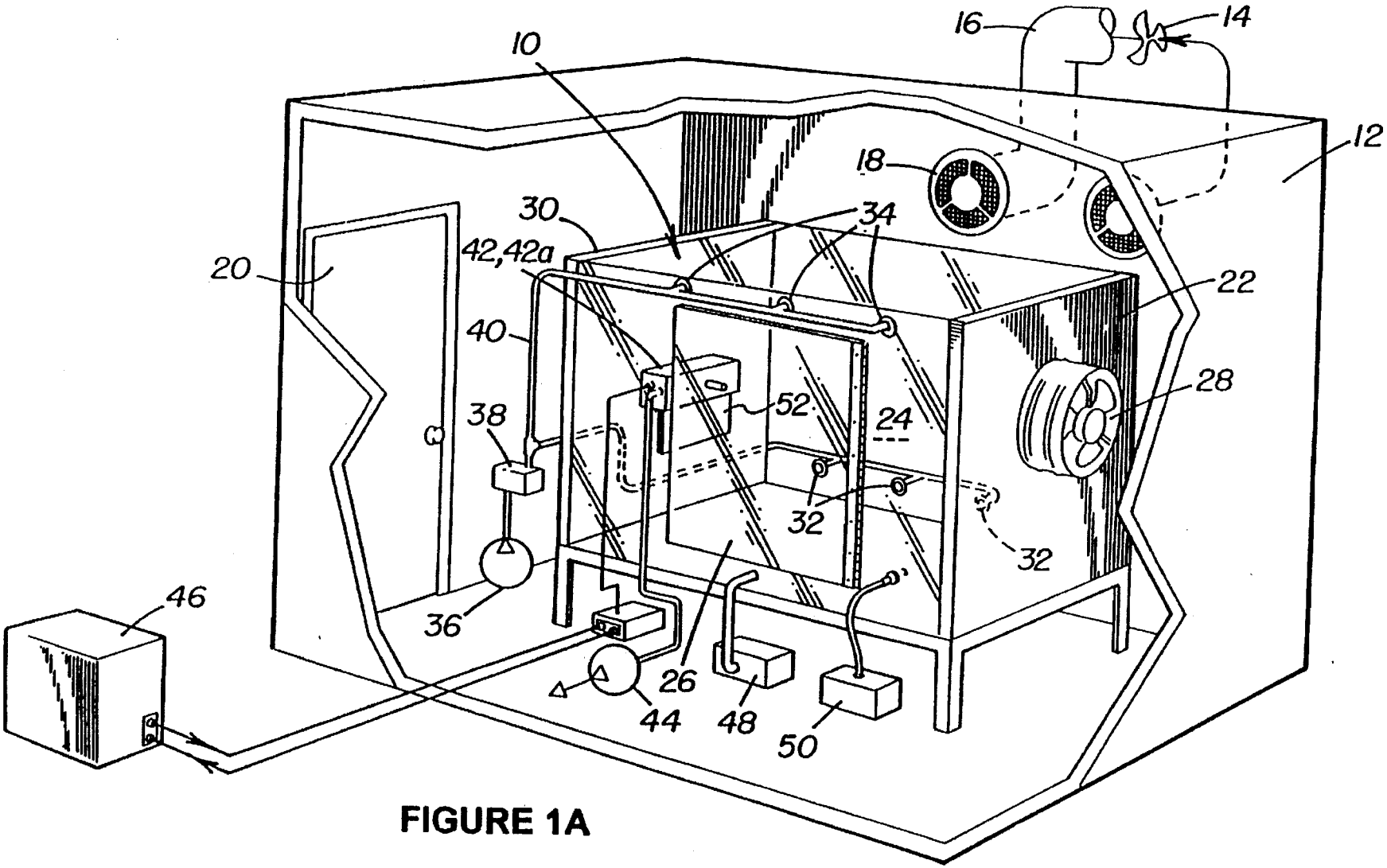
FIG. 1A is a perspective view of an ion particle measuring chamber which is broken away for illustration purposes.

Referring to FIG. 1A, a measurement changer 10 is located within room 12 which for purposes of illustration is shown broken away. Room 12 is an environmentally controlled room wherein air is supplied by means of a fan 14 through a duct 16 which includes an air filtering system 18. Air filtering system 18 includes a VLSI (Very Large Scale Integration) grade HEPA (High Efficiency Particulate Arrestor) filters such as available from Flanders Filters, Inc. located in Washington, South Carolina. Air filtering system 18 generally recirculates ambient air in room 12.

Access to room 12 is available through a normally closed door 20 to prevent unnecessary entry of contaminants or particles. If door 20 is closed and ambient air is provided to room 12 through air filtering system 18, the air contained in the room normally carries a relatively low particle count.

Measurement chamber 10 is located within room 12 and thus is provided with a relatively clean environment at the outset. Measurement chamber 10 defines an internal cavity 24 of a predetermined volume. Cavity 24 is formed sufficiently large to accept an article, e.g., an ion emitter tip, or piece of equipment that is known or suspected of being a particle emitter. Such articles may be found in existing clean rooms or it may be appropriate to use such an article in an existing clean room. However, before the article is placed in the clean room it is appropriate to determine if there is any particulate emission from that article. For example, small electric motors may very well give off aerosol size particles of metal or oil during normal operation. Such particulate matter could be ruinous to the manufacturer of semiconductor wafers or disk drives.

Measurement chamber 10 is constructed of a material that may be readily cleaned on the inside surfaces. A door 26 is affixed to one side of chamber 10 to provide access to the interior thereof. The door, when closed, is sealed to the rest of the chamber utilizing a rubber gasket to prevent ambient air in room 12 from entering the chamber during the test.

At least two matching VLSI grade HEPA filters, again available from Flanders Filters in Washington, S.C. are utilized to provide flow through air. The first filter 22 of the VLSI grade HEPA filter is affixed at one end of chamber 10 and includes an exterior fan unit 28 to provide a source of filtered air to the interior of chamber 10. At the opposite end of chamber 10 is a similar VLSI grade HEPA filter 30 to permit the air to be exhausted form chamber 10. It is noted that the filters at either end of chamber 10 are the type that have an inlet and outlet side for efficient filtering. It is to be understood that the inlet side of filter 22 is on the room side of chamber 10 while the inlet side of filter 20 is on the cavity 24 side of filter 30. In large test chambers, it may be appropriate to provide additional HEPA filters.

A key feature of chamber 10 is the inclusion of a plurality of air jets 32 and 34. Air jets 32 and 34 are located on opposite sides of cavity 24 preferably with one set located in the lower portion of cavity 24 and the other set in the upper portion of cavity 24. Further, the number of air jets 32 and 34 may vary depending upon the size of chamber 10. It is sufficient to have only one of the type 32 and one of the type 34. That is to have at least one air jet on opposite walls along the top and the bottom face of the chamber. In small chambers, a single jet may be sufficient. The purpose of these jets as opposed to the flow through air provided by fan unit 28 is to provide about two air changes of air per hour as make up air, and to ensure a thorough mixing of the atmosphere contained in the box in the chamber 10. The supply of air is provided from a compressor 36 which provides air to a filter unit 38.

Figure 1B:
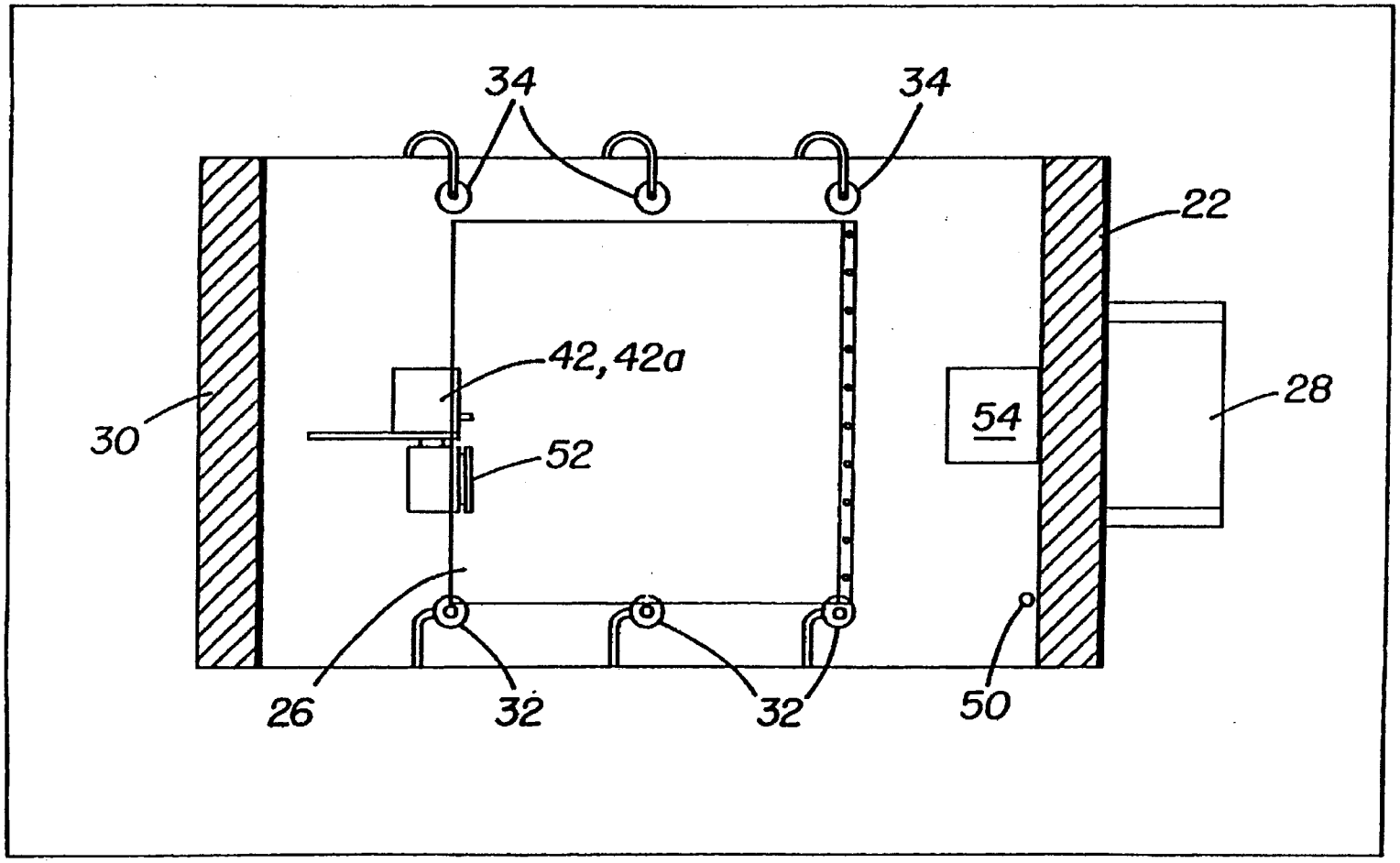
FIG. 1B is a schematic cross-sectional view of the chamber of FIG. 1A.
Figure 1C:
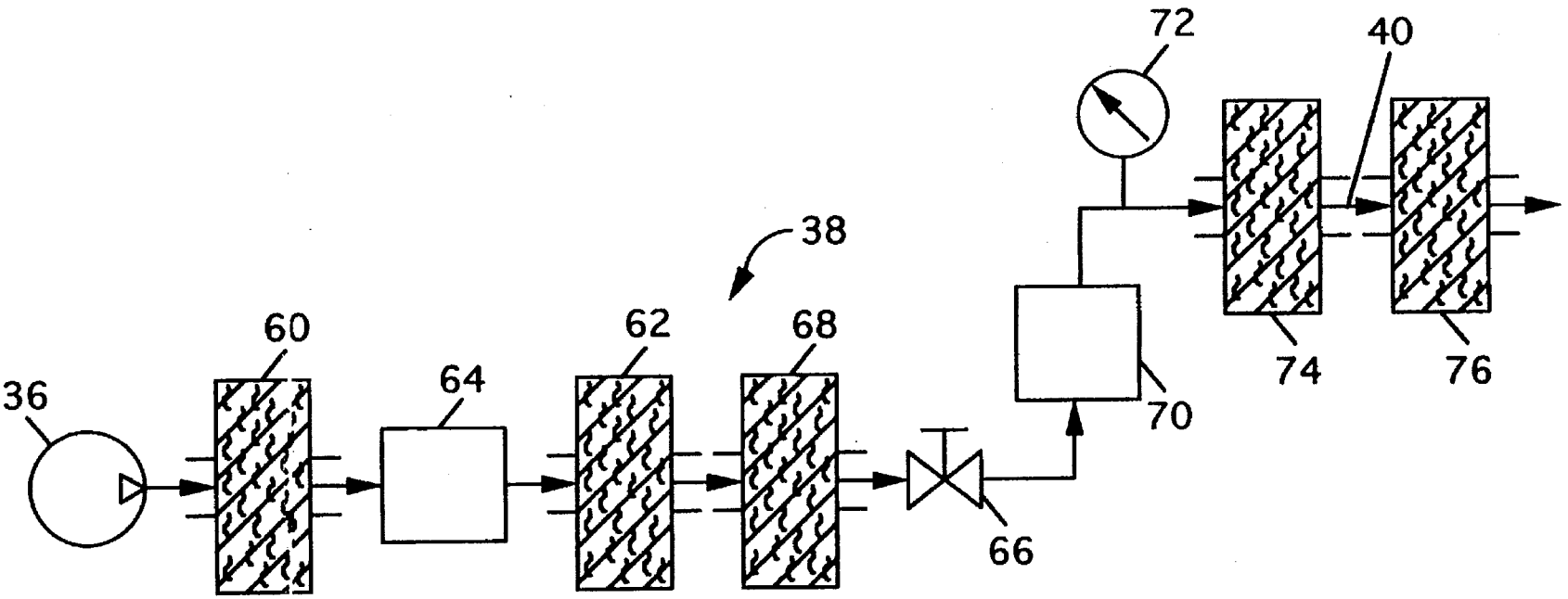
FIG. 1C is a schematic of the compressed air system used for make up air in the chamber.

Filter unit 38 is shown in detail in FIG. 1C. Air is provided to at least five stage filtering system. The first filter 60 is preferably a 5 micron filter, as is the second filter 62. Interposed between filters 60 and 62 is a pressure regulator 64. A needle valve 66 controls the flow of air leaving a third filter 68 which is just downstream of filter 62. Filter 68 is preferably a 0.1 micron filter. A flowmeter 70 is downstream of needle valve 66, with a pressure gauge 72 next in line. Finally a glass filter 74 communicates the air to conduit 40 which communicates the air to jets 32 and 34. Located at each jet are the final filtration stages which consist of at least one 0.02 micron membrane filter 76 exhausting directly into the box. These filters are available from Millipore Corp., 80 Ashby Road, Bedford, Mass. 01730. This provision, in the static test, provides a slight positive pressure within cavity 24 thus preventing outside particles from leaking into measurement chamber 10.

What has been described to this point is the minimum structure to provide either a static chamber or a flow through chamber for the testing of equipment. What remains to be described is the equipment necessary to conduct the test of the ion emitter tip.

Particle counting is accomplished with a counter 42. Counter 42 includes at least a capability of detecting particles at least as small as 0.005 microns. Such counters are available from TSI, Inc. at 500 Cardigan Road, St. Paul, Minn. In particular Model 3760 condensation nucleus counter detects particles larger than 0.014 microns at a sample rate of 1.42 liters per minute. This particle counter, as can be seen from FIG. 1 sits inside cavity 24 and draws air into the counter directly from cavity 24. A vacuum pump 44 provides the necessary air flow through the particle counter. The location of the particle counter 42 would be important to the test, particularly, the location of the particle counter in relation to the article to be tested. In the particular example utilized, the particle counter is one meter from the emitter tip being tested.

Output from the particle counter 42 is communicated to a computerized system 46 for appropriate manipulation. It has been found that the particle counts may be logged into a computerized system that selects the particle count at a predetermined interval such as every two minutes and saves the data in a memory storage. The data is then available for manipulation in commercial spread sheet programs.

In addition to the aforedescribed particle counter, an additional counter may also be necessary to count larger size particles. Such a counter which shall be identified as 42A is available from Particle Measuring Systems located at 1855 South 57th Court, Boulder, Colo. 80301. This particular device measures particles larger than 0.1 microns and further classifies them into size categories.

During the flow through tests, it is appropriate to measure the velocity of air passing through cavity 24. Such is done with thermoanemometer 50. Such an instrument is available from Kurtz Instruments, Inc. at 2411 Garden Road, Monterey, Calif. 93940.

In an event an air ionizer is being tested in the chamber, it is appropriate to include a field meter to reach charges in the vicinity of the particle counter. Such a meter is shown as meter 52 and is available from Trek Inc., 3932 Salts Works Road, Medina, N.Y.

In order to monitor the test environment when testing an ionizer, it is also appropriate to include an ozone meter that measures ozone concentrations to the parts per billion level. Such a meter is shown as ozone meter 48 and is available from Dasibi Environmental Corporation in Glendale, Calif.

In referring now to FIG. 1B, a view of chamber 10 is shown in elevation. In FIG. 1B, the article 54 to be tested is illustrated.

Detailed Description of FIGS. 2A to 9B

Overall as is shown in FIGS. 2A to 9B, useful emitter tip materials of the present invention are those from which a small number of particles are generated. In the "A" designated figures, the useful materials have few particles generated. Compare, for example, the pattern of particles generated from useful titanium material of FIG. 7A with not useful tungsten or platinum FIGS. 2A or 5A. In the "B" designated Figures, the useful materials generate a pattern of few particles and the closer the plot is to the x-axis the better the emitter material.

Figure 2A:
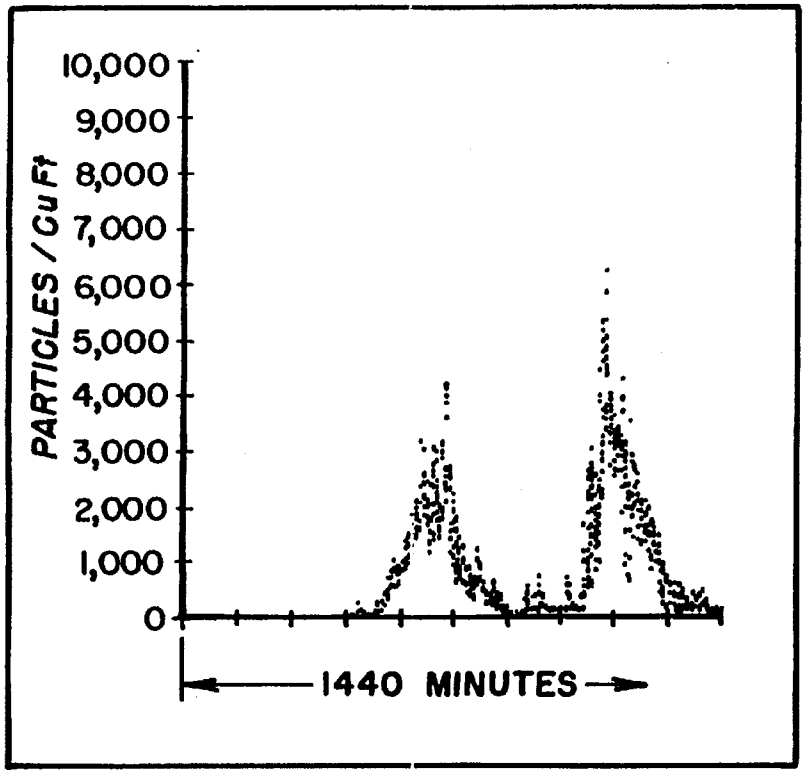
FIG. 2A shows a graph of the particles emitted using a tungsten-2% thorium needle tip in a flow-through air chamber.
Figure 2B:
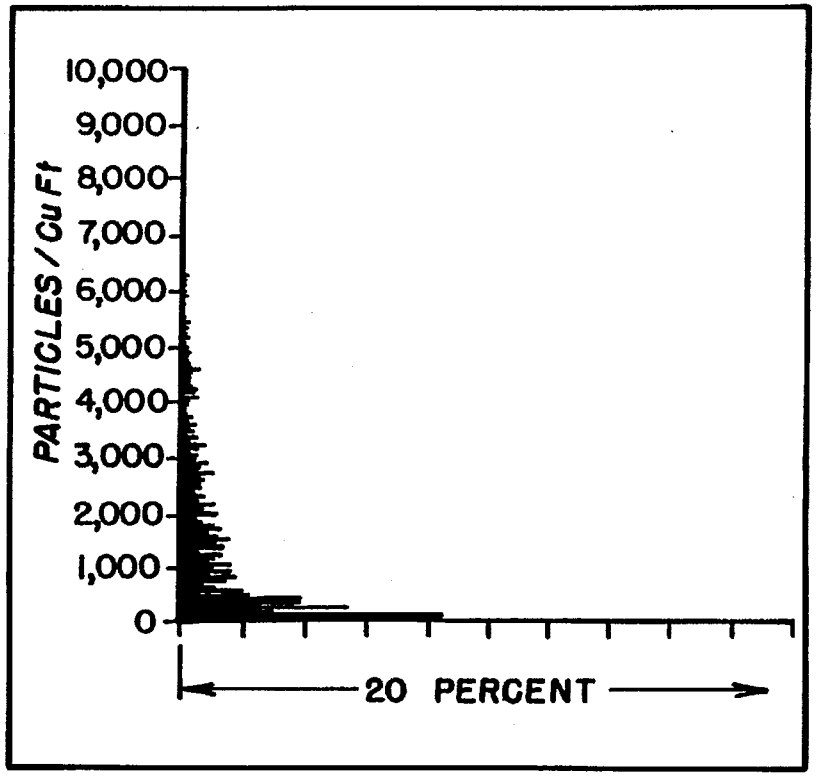
FIG. 2B shows a graph of the percentage distribution of the particle count of FIG. 2A.

FIG. 2A is a graph of the particle emitter using a tungsten-2% thorium needle tip in the flowing air chamber described herein. Note the essential absence of particles produced during the first six hours. When the electrode is "damaged" after about six hr, the number of particles emitted increases dramatically. FIG. 2G shows in percentage format the pattern of the particles emitted.

Figure 3A:
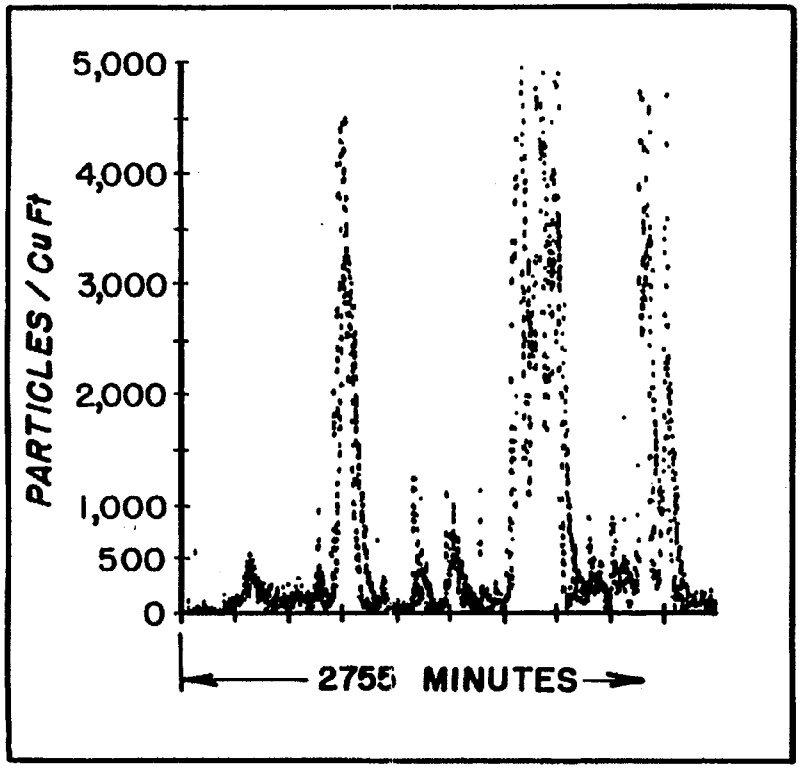
FIG. 3A shows a graph of the particles emitted over 2,755 minutes from a standard tungsten-2% thorium emitter tip in a static chamber.
Figure 3B:
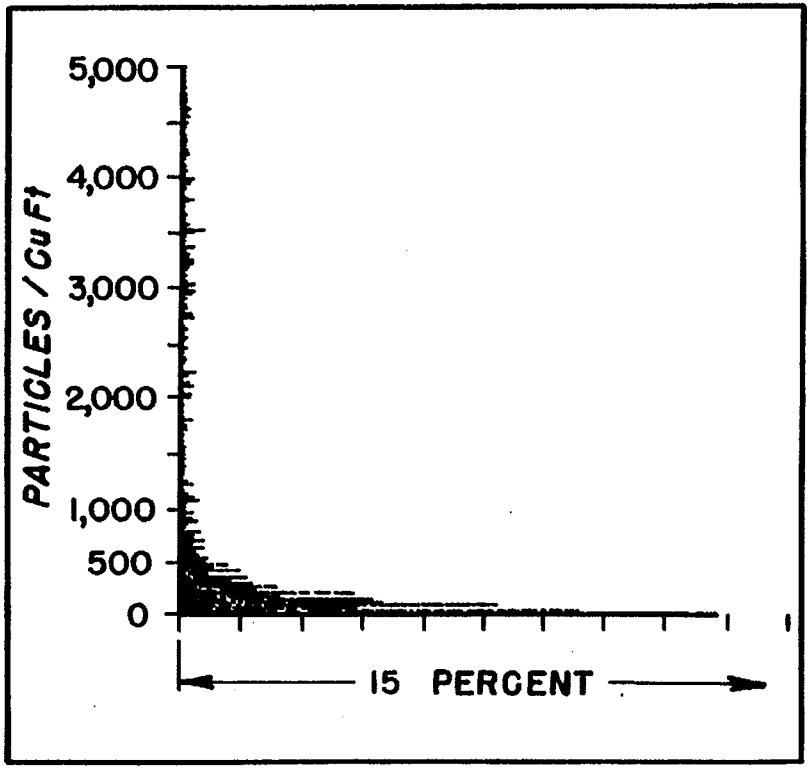
FIG. 3B is a plot of the percentages of the particle count of FIG. 3A.

FIG. 3A is a graph of the particles emitted from a standard tungsten-2% thorium emitter tip in a static chamber. Again, the number of particles emitted are at too high a level to produce Class 1 conditions. FIG. 3B shows in percentage format the pattern of the size of particles emitted.

Figure 4A:
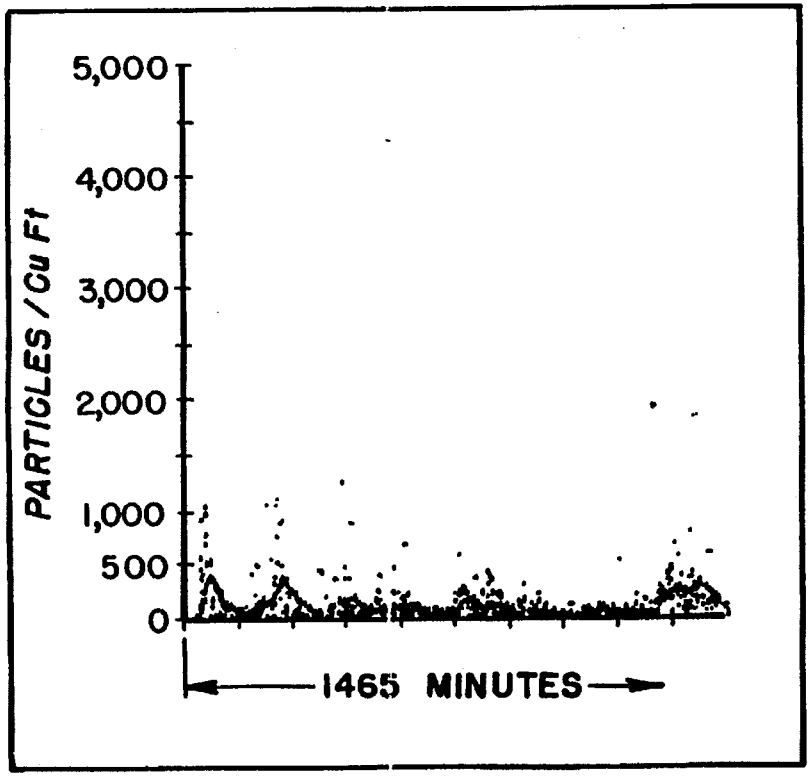
FIG. 4A shows a graph of the particles emitted over 1,465 minutes from a 0.012 inch diameter tungsten-2% thorium emitter wire filament in a flowing air chamber.
Figure 4B:
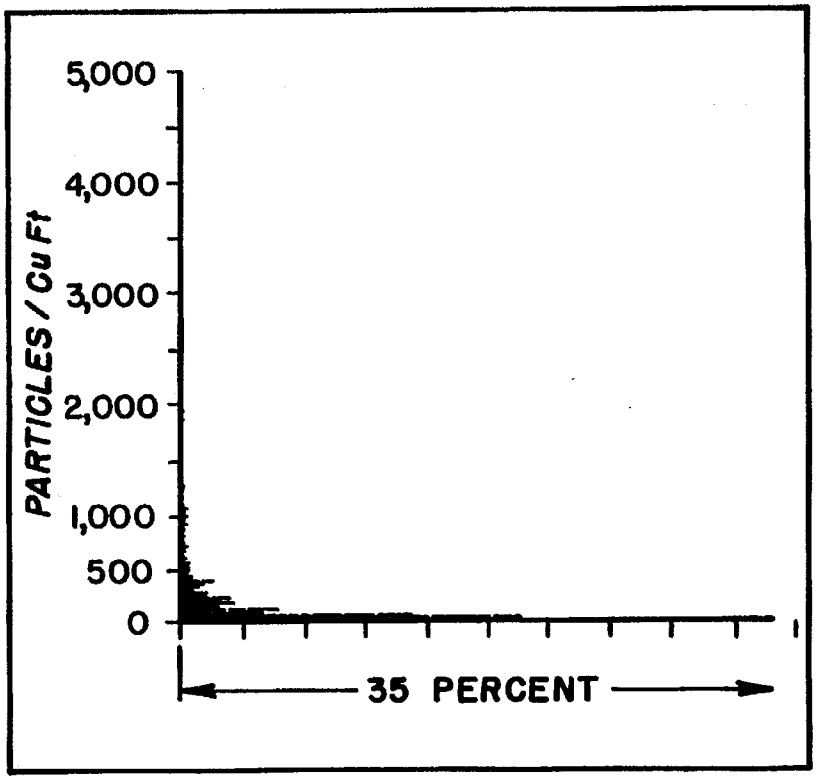
FIG. 4B is a plot of the percentage of the particle count of FIG. 4A.

FIG. 4A is a graph of the particles emitted from a tungsten-2% thorium emitter wire filament in the flowing air chamber. Note the particle level is too high to process Class 1 clean room conditions. FIG. 4B shows in percentage format the pattern of the size of the particles emitted.

Figure 5A:
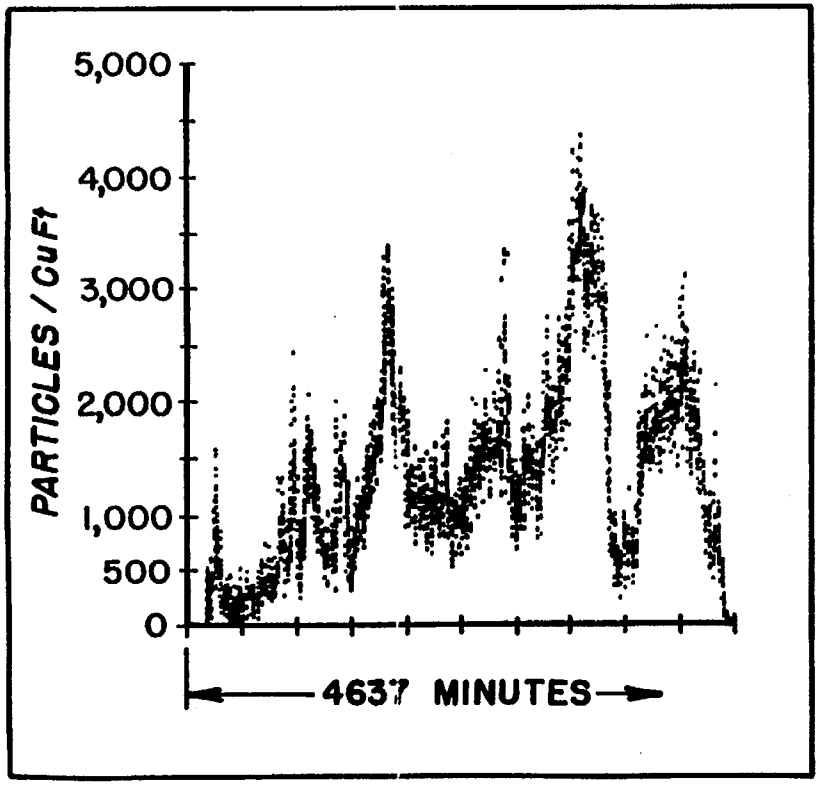
FIG. 5A shows a graph of the particles emitted from a platinum wire of 4,637 minutes in a static box.
Figure 5B:
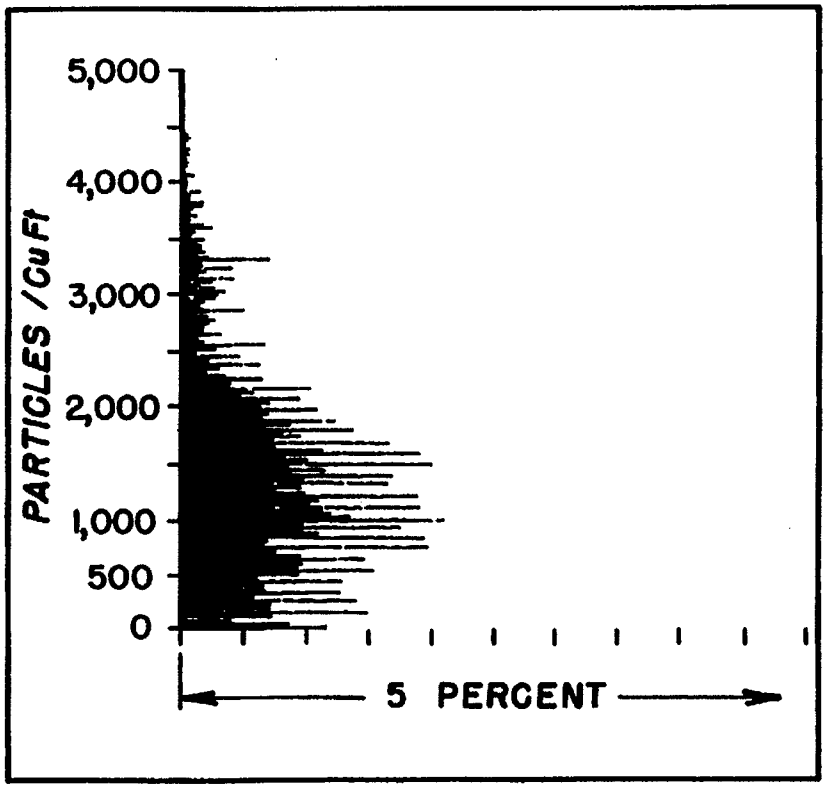
FIG. 5B shows a plot of the particle count of FIG. 5A.

It was expected that a noble metal such as platinum would be useful emitter to produce Class 1 conditions. In FIG. 5A is a graph of the particles emitted from a platinum wire in a static chamber. FIG. 5B shows in percentage format the pattern of the size of the particles emitted. surprisingly, the platinum emitter tip produced far too many particles to be considered for class 1 conditions.

Figure 6A:
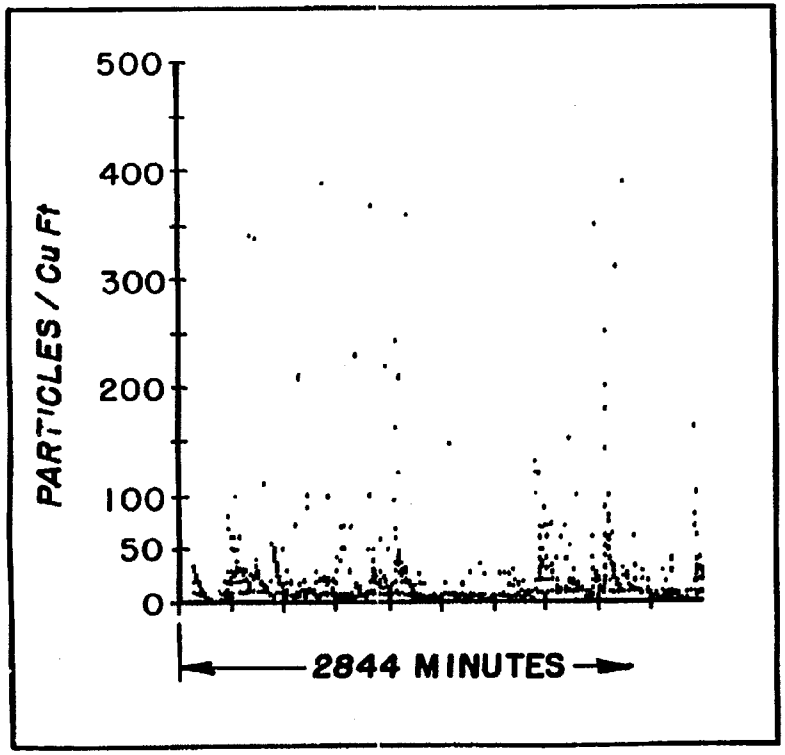
FIG. 6A shows a graph of the particles emitted from a titanium wire over 2,844 minutes in a static box.
Figure 6B:
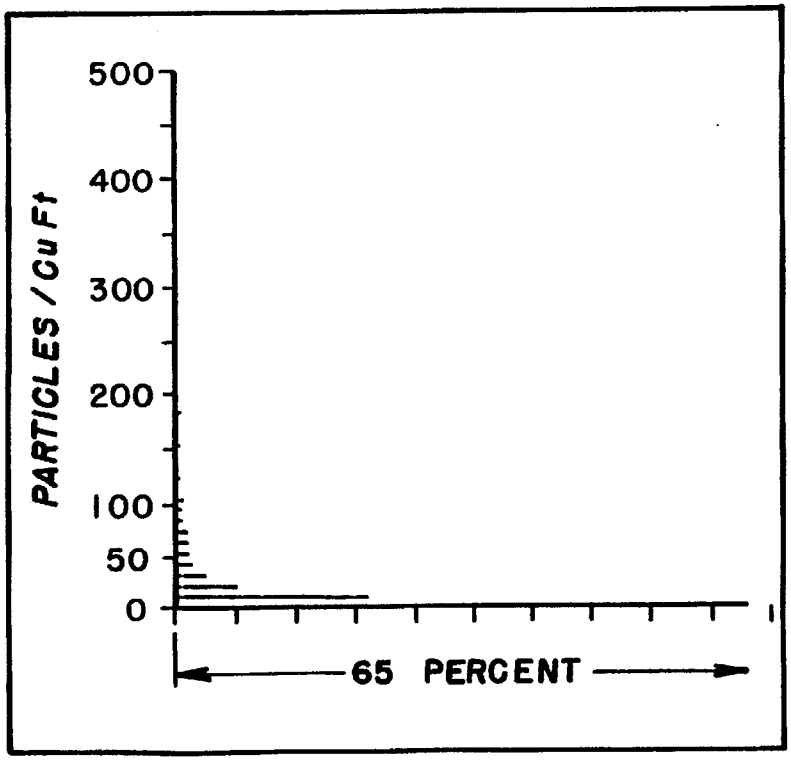
FIG. 6B shows a plot of the particle count of FIG. 6A.

FIG. 6A is a graph of the particles emitted from a titanium wire in a static chamber. Note the low level of the number of particles. FIG. 6B as a percentage plot of FIG. 6B shows a type of pattern useful to produce Class 1 clean room conditions.

Figure 7A:
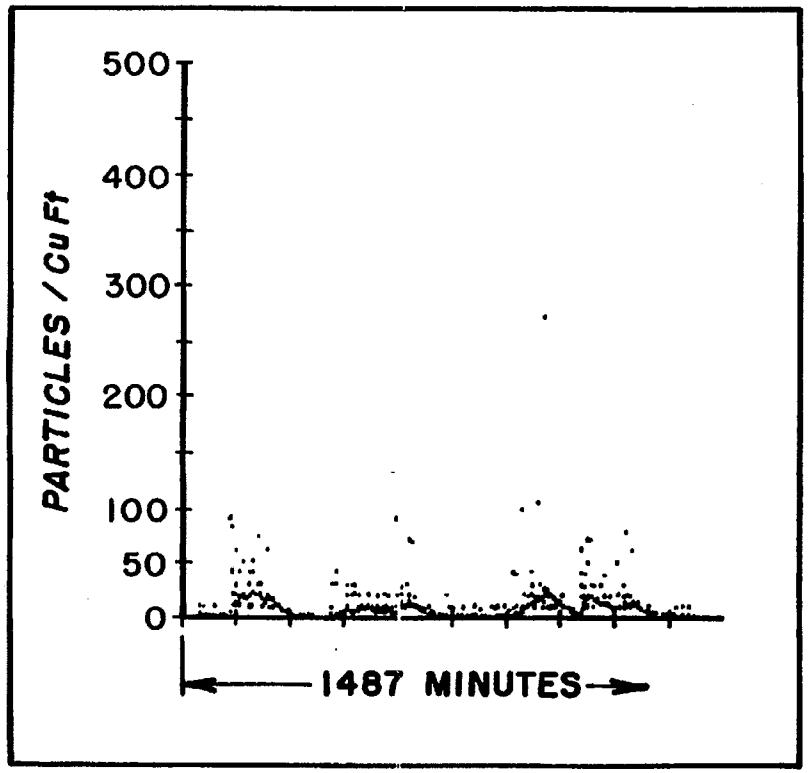
FIG. 7A shows a graph of the particles emitted from a titanium wire over 1,487 minutes in a flow chamber.
Figure 7B:
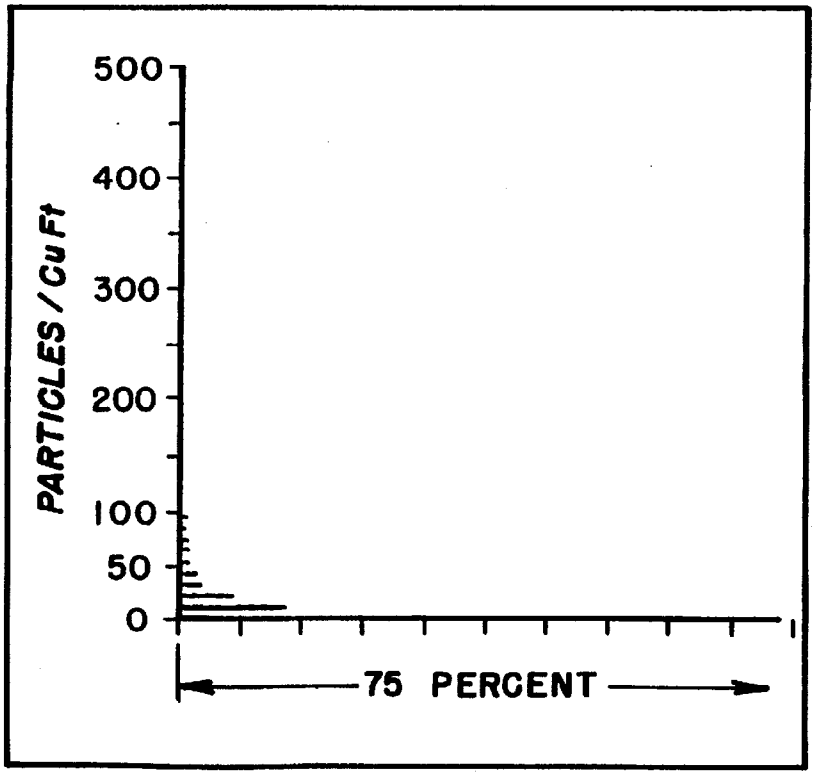
FIG. 7B shows a plot of the particle count in FIG. 7A.

FIG. 7A is a graph of the particles emitted from a titanium wire in a flowing air chamber. Again, note the low number of particles emitted. FIG. 7B as a percentage plot of the particles of FIG. 7A shows a type of pattern useful to produce Class 1 clean room conditions.

Figure 8A:
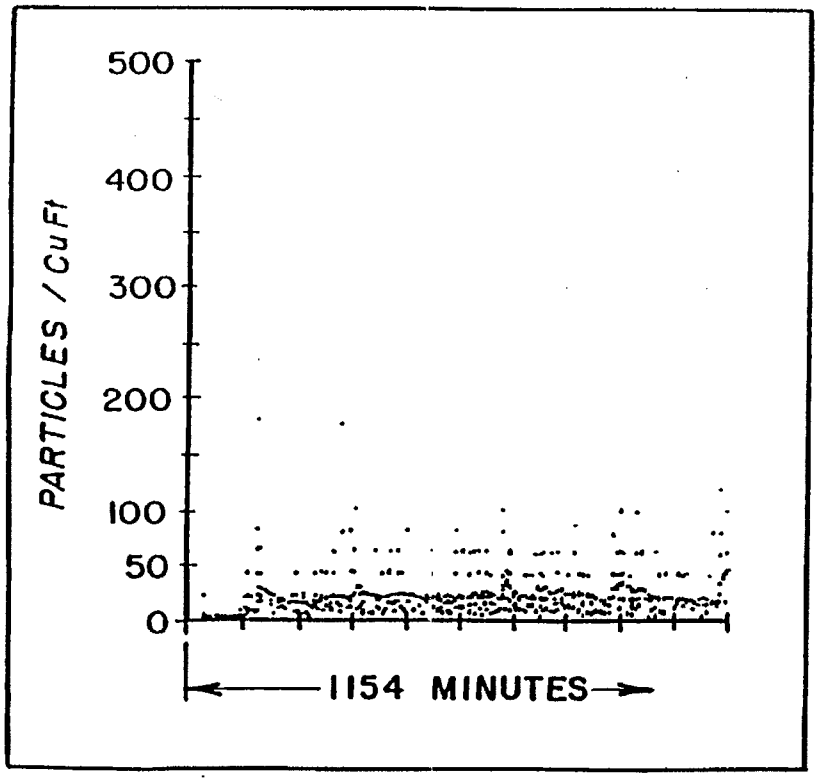
FIG. 8A is a graph of the particles emitted over 1,154 minutes from 0.02 inch diameter zirconium wire in a static box.
Figure 8B:
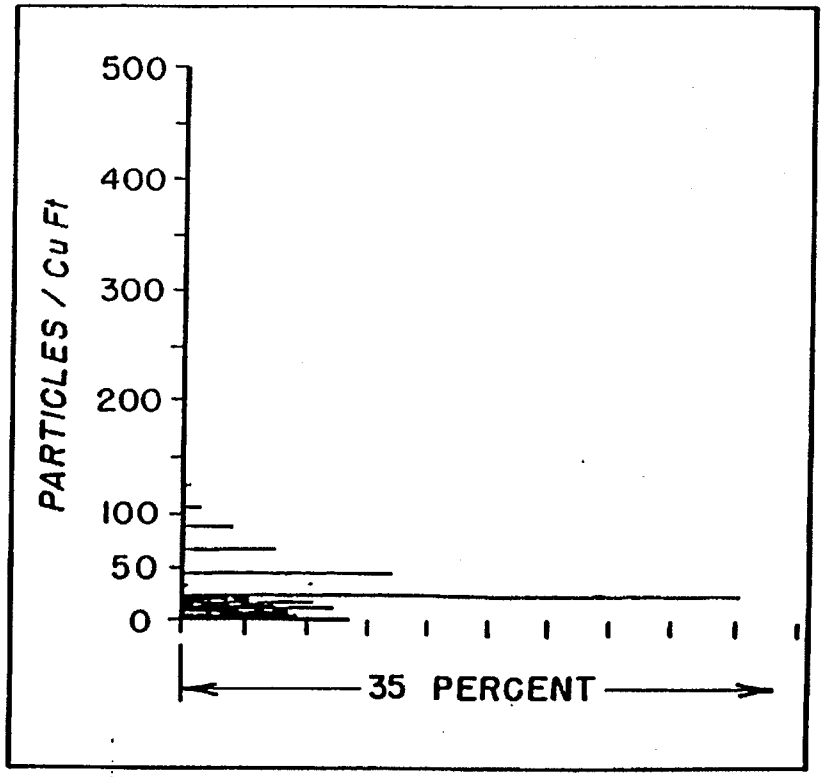
FIG. 8B is a plot of the percentages of the particle count of FIG. 8A.

FIG. 8A is a graph of the particles emitted from a zirconium wire emitter tip in a static air chamber. The number of particles emitted are larger than for titanium, but are still low enough to produce Class 1 conditions. FIG. 8B is a percentage plot of the particles of FIG. 8A.

Figure 9A:
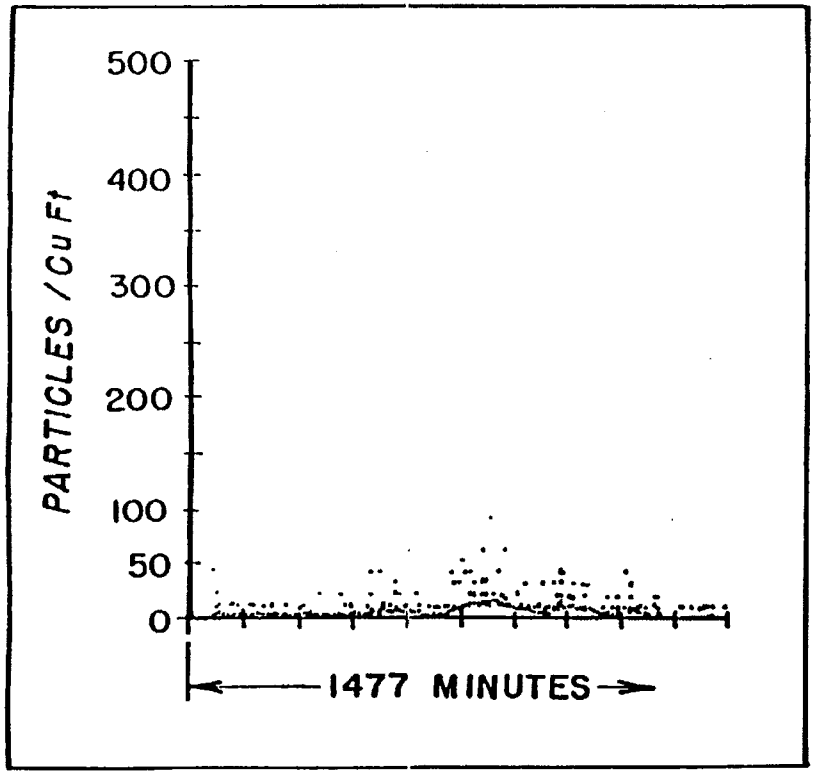
FIG. 9A is a graph of the particles emitted over 1,477 minutes from a 0.02 inch diameter zirconium wire in a flow chamber.
Figure 9B:
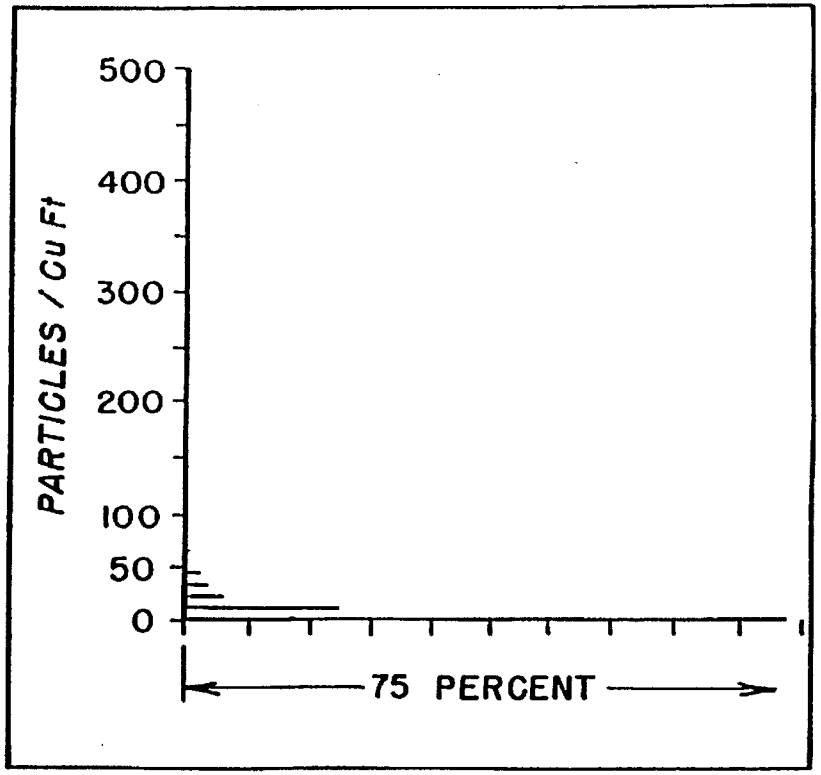
FIG. 9B is a plot of the percentage of the particle count of FIG. 9A.

FIG. 9A is a graph of the particles emitted from a zirconium wire in a flow air chamber. Note the low level of particles produced and the pattern. FIG. 9B as a percentage plot of FIG. 9A shows a type of pattern for a material which is useful to produce Class 1 conditions.

Present ionization technology uses primarily tungsten-2% thorium (W-2% Th) emitters in either a needle or wire geometry. Both wires and needles were tested to assess the particle production of these widely used materials, and found both geometries gave similar results. All tests of new materials used single strands of 0.01 to 0.02 inches in diameter wires. FIGS. 2A to 4B show flow-through and static chamber particle counts from W-2% The needles that had been used in a clean room for more than 10,000 hrs prior to testing. These tests were performed at normal ion emitter current and voltage levels. These figures show a substantial amount of particle production with average particle levels of 160 to 810 particles per cubic foot in the flow through and static box tests respectively.

To avoid corrosion damage, particularly oxidation, a choice for an emitter material would be a noble metal from the platinum group. However, in a static box the results of three days of testing showed substantial particle production, with average levels of about 1,300 particles per cubic foot. This result is not an improvement over the present tungsten-2% thorium material.

An alternative strategy is to choose a material which resists corrosion damage by forming a protective layer on the surface of the material. In particular, metals like zirconium, titanium and aluminum form protective oxide layers that have ceramic like qualities. 99.99% Pure zirconium and titanium wire were tested in a static air chamber and flow through air chamber with the results presented in FIGS. 6A to 9B. These materials had greatly reduced particle emissions. Average particle levels for titanium points were about 1.3 particles or lower per cubic foot for the flow-through or static chamber condition, which is about 100 times lower than observed using tungsten emitter tips under the same conditions. In long term tests, the titanium tips remained about the same length after several months, but formed a visible white coating on the tip after a few days of operation. This coating (probably titanium dioxide) clings tenaciously to the tip and cannot be removed, even by ultrasonic cleaning. Only mechanical scraping of the emitter tip with a file removed the coating.

Zirconium also produced low particle counts, but in long term tests the emitter tips eroded. Some persistent white coating of the emitter tip was observed. The zirconium tips probably oxidize but leave little particle residue. This may provide the basis of self-cleaning emitter property that has previously not been disclosed for zirconium.

To resist corrosion damage some metals form a protective coating. Zirconium and titanium wire (both 99.99% pure) were tested under ordinary operating conditions of 2.0 microamperes. The results are shown in FIG. 6A and 9B.

These metals had greatly reduced particle emissions under both static air and flowing air conditions.

The mean particle levels for titanium emitter tips were about 1.3 particles or less per cubic foot, which is about 100 times lower than the industry standard tungsten-2% thorium tips. In long term tests under standard operating conditions of 2.0 microamperes, the titanium tips remained about the same length after several months.

Additional alloys of the present invention are tungsten and titanium or tungsten and zirconium. Preferred concentrations are those which comprise up to 70% tungsten, and more preferred are those having less than 30% by weight tungsten. In another aspect, the tungsten is at a level of about 70% and the zirconium or titanium are at a level of between about 1 and 30% by weight. In another aspect, the tungsten level is at a level of between about 1 and 30% by weight and the titanium or zirconium are at a level of about 70% by weight.

The following Examples are for the purpose of explanation and description only. They are not to be construed as being limiting in any way.

EXAMPLE 1

COMPARISON OF EMITTER TIP MATERIALS

Metals and metal alloys were tested under comparable test conditions both in a static chamber and in a flowing air chamber. The test conditions used were as follows and the results are summarized in Table 1.

The following test conditions were used for all experiments.

(a) The current in each emitter tip is regulated to maintain 2 microamperes during the test. Both negative and positive ions were generated during the test to produce a bipolar ion mixture. The ionization voltage and current was supplied by Nilstat model 5000 (Ion Systems, Inc., 2546 Tenth St., Berkeley, Calif. 94710) sequences bipolar ionization system using a 2 second on time and 1 second off time for each ion polarity. The same ionization system was used for all tests. Each test used one pair of identical emitter tips, one tip supplied with positive voltage and the other negative voltage.

(b) Particle counts were gathered at 1 meter from the ionization tips, at a point centered between the pair of tips. Particle as small as 0.01 microns were counted with a CNC. Particles larger than 0.05 microns were counted with an optical laser counter.

(c) The air flow rate into the static chamber tests was a constant 2 cubic feet per minute.

(d) The air flow rate in the flow-through chamber tests was a constant 440 cubic feet per minute.

TABLE 1

COMPARISON OF EMITTER TIP MATERIALS

| Exper. No. | Tip Composition | Diam. ($\times 10^{-3}$ in.) | Comment |
|---|---|---|---|
| 1a | Tungsten/ 2% Thorium | 80 | Particle size of 0.02 microns or larger. Not a Class 2 emitter. (See FIGS. 2A and 2B). (See FIGS. 3A and 3B). |
| 2 | Tungsten/ 2% Thorium | 12 | Particle size of 0.02 microns or larger. Worse than Experiment 1. |
| 3 | Tungsten/ 2% Thorium | 20 | Slightly better than Experiment 2. (See FIGS. 4A and 4B). |
| 4 | Tungsten/ (99.9 + %) | 12 | Equivalent or worse than Experiment 2. |
| 5 | Tungsten/ 3% rhenium | 20 | Three to four times better than Experiment 1. |
| 6 | Platinum (99.97%) | 10 | Particle size of 0.02 microns or larger. Not a Class 1 emitter. (See FIGS. 5A and 5B). |
| 7 | Platinum (99.97%) | 20 | Particle size larger than 0.02 microns. Worse than Experiment 2. |
| 8 | Platinum 10% Iridium | 10 | Particles greater than 0.05 microns. Not a good Class 1 emitter. |
| 9 | Platinum 5 | | Not as good as Experiment 1. |
| 10 | Zirconium/ Hafnium | 10 | Particles less than 0.05 microns. Good Class 1 emitter. |
| 11 | Zirconium | 17 | Particles less than 0.05 microns. Good Class 1 emitter. (See FIGS. 8A and 8B). (See FIGS. 9A and 9B). |
| 12 | Titanium | 22–23 | Few particles. Good Class 1 emitter. (See FIGS. 6A and 6B). (See FIGS. 7A and 7B). |
| 13 | Tantalum | 20 | Three to 4 times better than Experiment 1. Class 1 emitter. |
| 14 | Nichrom | 20 | About equivalent to Experiment 1. |
| 15 | Nichrom | 20 | About equivalent to Experiment 1. |
| 16 | Copper | 20 | Erodes rapidly - many particles. Worse than Experiment 1. |
| 17 | Haynes | 35 | Not as good as Experiment 1. |
| 18 | Stainless Steel #304 | 5 10 | All about equivalent to Experiment 1. Stainless degrades |

TABLE 1-continued

COMPARISON OF EMITTER TIP MATERIALS

| Exper. No. | Tip Composition | Diam. ($\times 10^{-3}$ in.) | Comment |
|---|---|---|---|
| | alloy | 20 30 40 | faster than Experiment 1. |

(a) All Experiments are with wire tips i.e., cylindrical tip with an 0.08 inch shaft except Experiment 1, which had an 0.08 in. shaft with a 0.005 inches tip radius. Experiment 7 used a loop of about 1.0 cm.
(b) The metal tip materials described herein are commercially available from the Chicago Development Corporation, #1 Highway N, P.O. Box 266 Ashland, Virginia 23005, U.S.A.
(c) The test chamber is also described in detail in M. Yost, et al. Microcontamination Vol. 7 (#9) September 1989, pg. 33.

General Description of the Coating Process

Pure titanium (99.9%) (or substantially silicon) 80 mil diameter needles were coated with a layer of pure silicon (having less than 1 part boron in 10,000 Si) by an electron beam physical deposition process.

The steps for coating the titanium needle points are as follows:

1. Cleaning the Ti surface by abrasive blasting with a fine mesh aluminum oxide e.g. about 1000 mesh.

2. Heating the Ti needle point to 1000 degrees F. in a high vacuum ($<1\times10^{-4}$ mmHg).

3. Moving the points (while under vacuum) into a e-beam chamber, and depositing Si for between about 30 to 120 minutes. The points are continually rotated in a planetary pattern while in the chamber to achieve a uniform coating.

4. Cooling gradually the coated points for between about 1 to 3 hours.

The silicon coatings can be made on the metal or metal alloy tips by conventional commercially available equipment.

Preferably the silicon coatings herein are available under contract from Electron Beam Vacuum Coatings, Inc., 2830 7th Street, Berkeley, Calif. 94710, U.S.A. Coatings of between 1 to 100 microns are preferred, wherein 1–50 microns are more preferred.

Experimental Test Results for Coated Emitter Tips

The emitter tip coated points were tested in the chamber described in copending U.S. Ser. No. 346,073, using the same standard conditions: constant 2 micro-amp emitter current, all particles with size 0.015 microns measured with a TSI condensation nucleus counter (CNC). Most tests were done in the "static chamber" mode, since this gives the greatest sensitivity, with the one exception noted below which was done in a flow-through mode which simulates a cleanroom operating environment. FIG. numbers 10–17 refer to the attached graphs produced by the analysis software. Experience with the chamber indicates that average static box CNC counts of around 200 or less will generally satisfy class 1 conditions.

DETAILED DESCRIPTION OF FIGS. 10–18

Figures 10A, 10B:
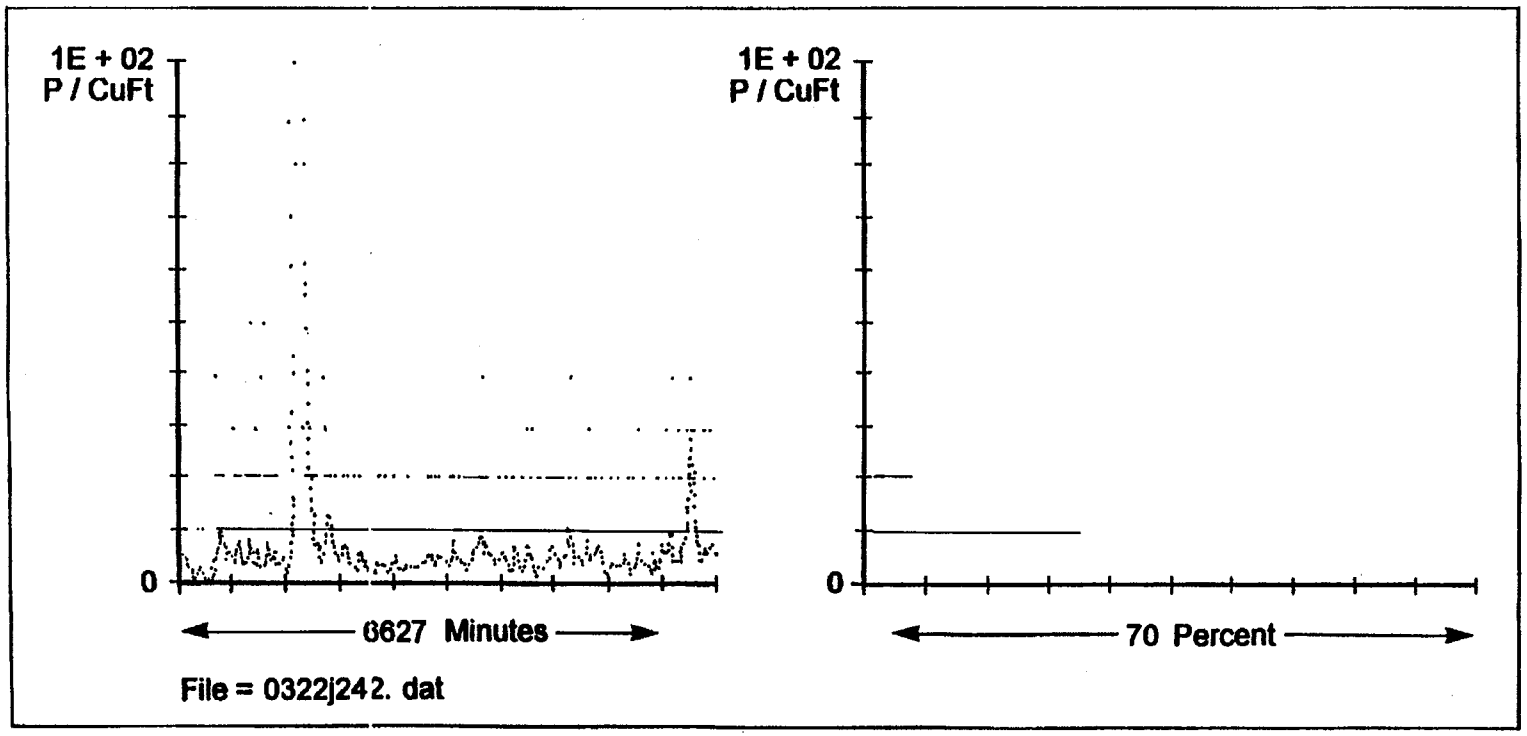
FIG. 10A is a graph of a Ti emitter tip coated with 47 micron of silicon in a static box test.
FIG. 10B is a graph of the percentage distribution of the particle count of FIG. 10A.

FIG. 10 is a graph of Ti coated with 47 micron Si coating in a static box test. This was the first of a series of tests of coated points. The average was about 8 particles per cubic foot, which is much better than observed for pure Ti points.

Figures 11A, 11B:
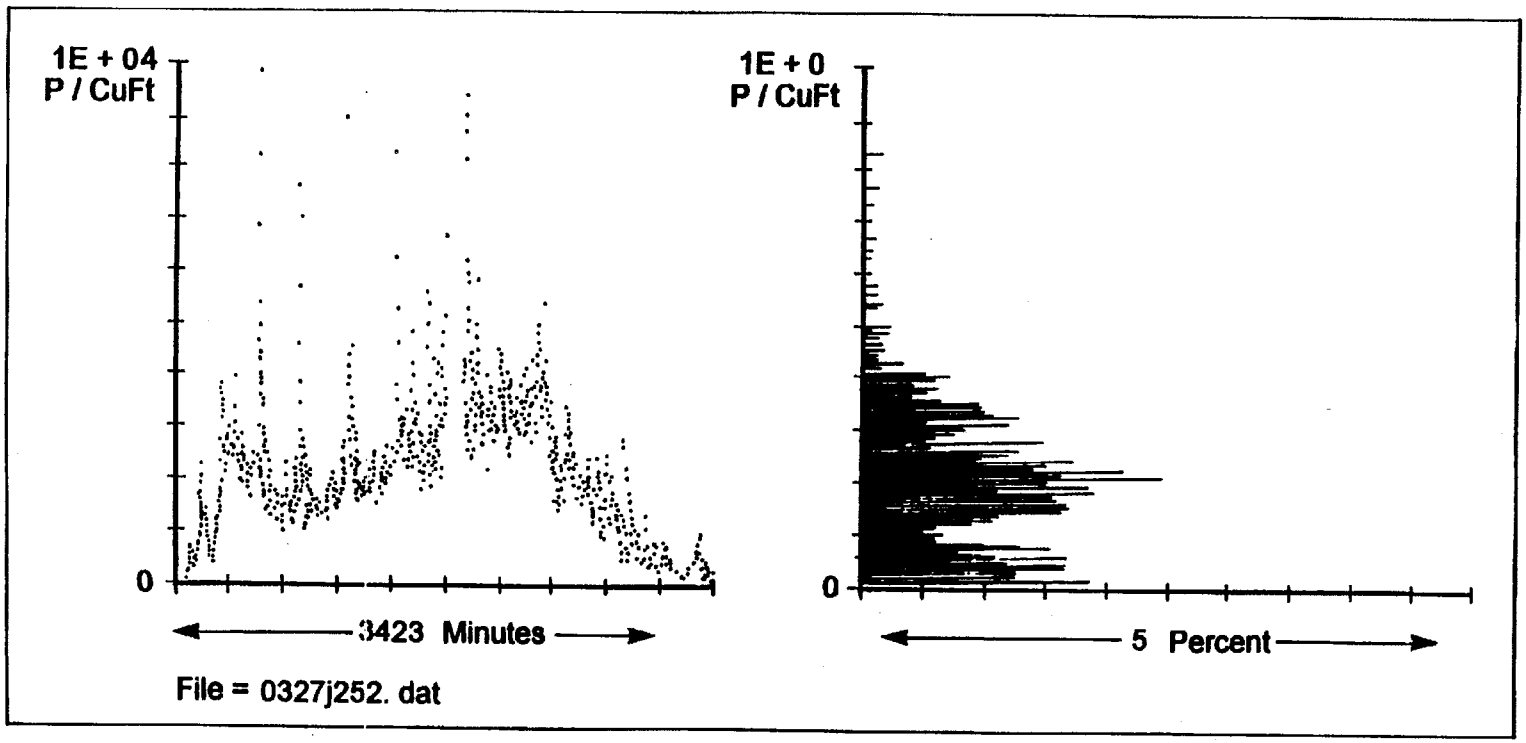
FIG. 11A is a graph of a Ti emitter tip electroplated with platinum in a static box test.
FIG. 11B is a graph of the percentage distribution of the particle count of FIG. 11A.

FIG. 11 is a graph of a Ti tip electroplated with platinum, static box test. This test demonstrated that a different coating material would not give the same result. The average count for platinum plated points is about 2,600 particles per cubic foot, which is similar to tests of Pt wire, and far higher counts than pure Ti points. Previous tests with Pt wire had indicated that it would probably not be a good class 1 material.

Figures 12A, 12B:
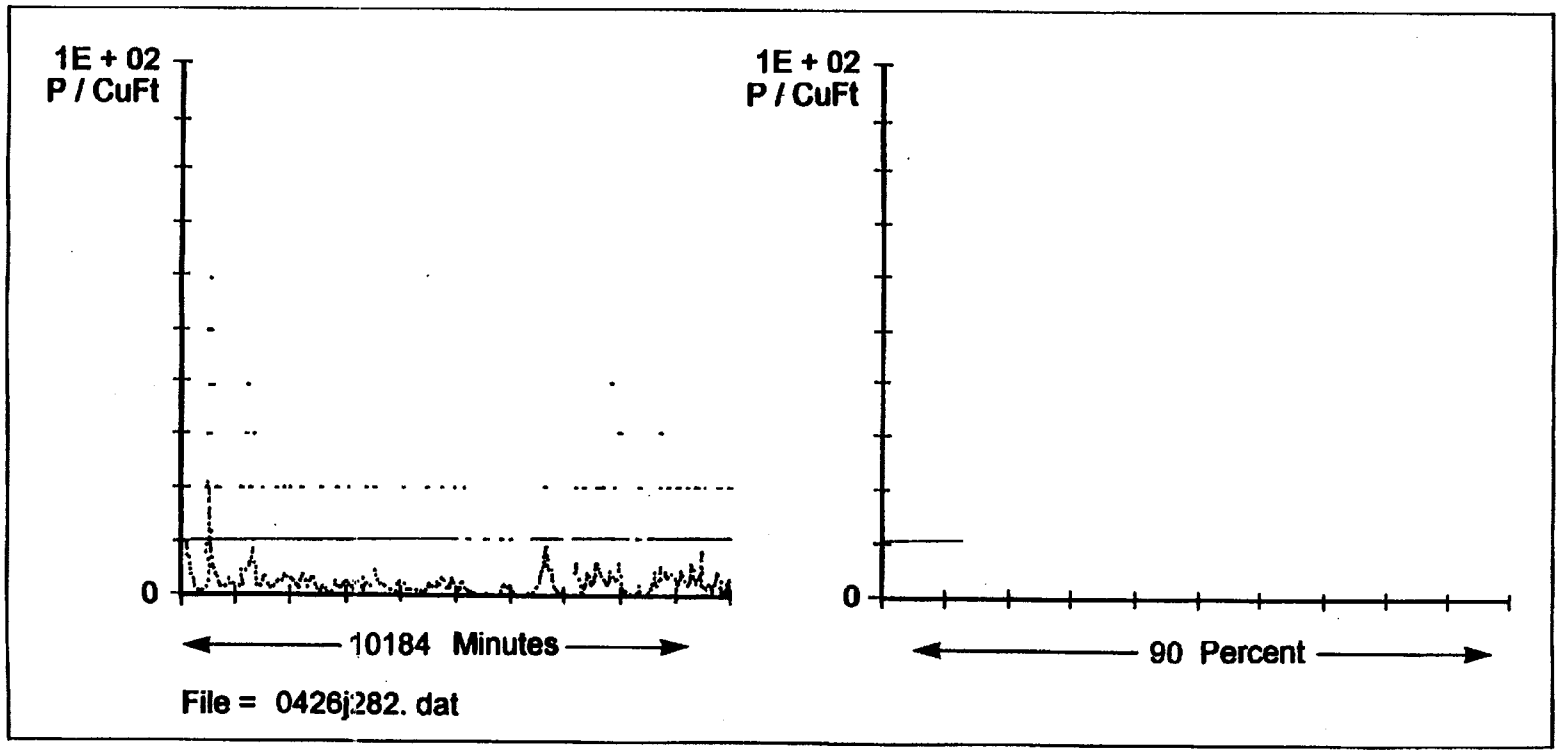
FIG. 12A is a graph of a test of a Ti tip coated with 47 microns of silicon.
FIG. 12B is a graph of the percentage distribution of the particle count of FIG. 12A.

FIG. 12 is a graph of another test of Ti coated with 47 microns of Si repeating the static box test in FIG. 10. The average count was 1.3 particles per cubic foot.

Figures 13A, 13B:
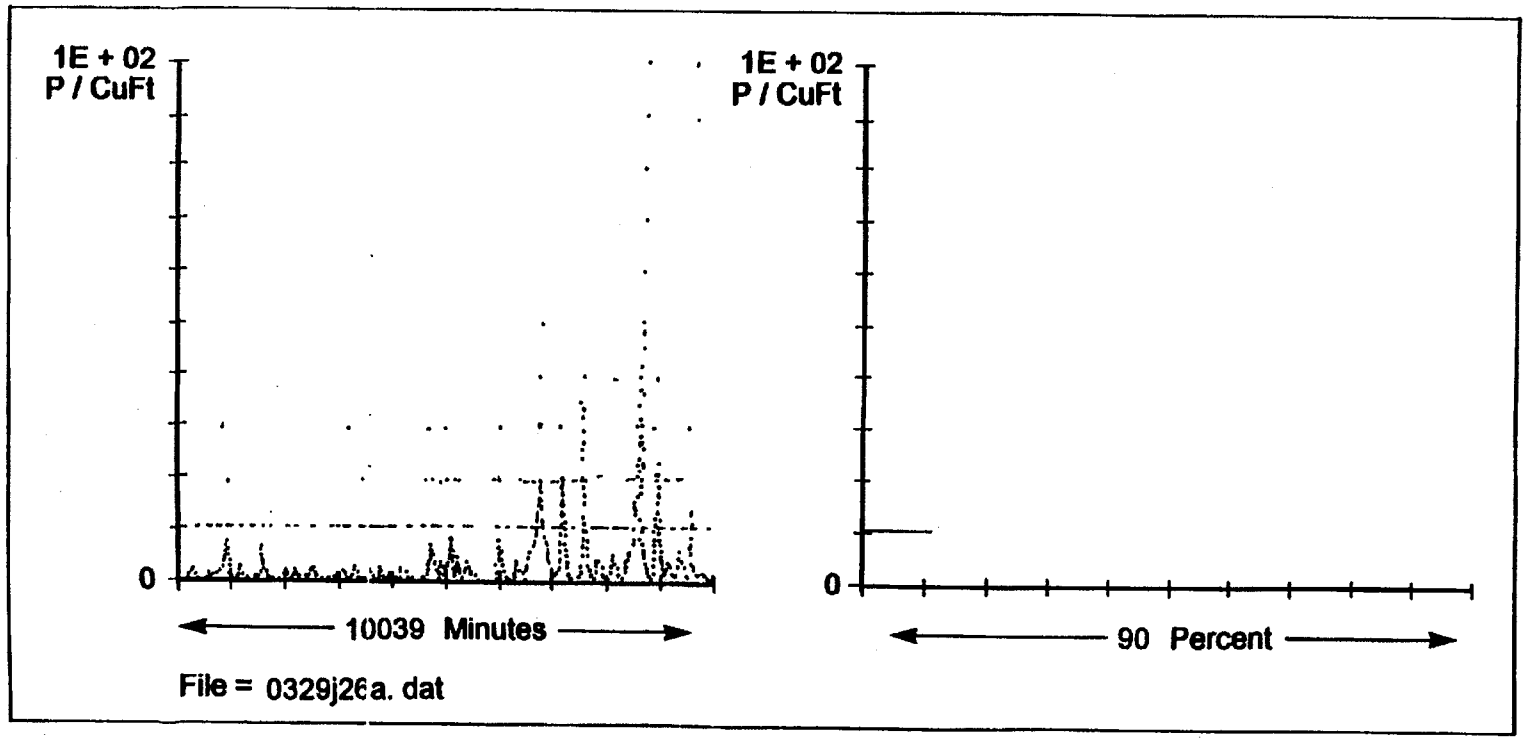
FIG. 13A is a graph of a continuation of the test of FIG. 12.
FIG. 13B is a graph of the percentage distribution of the particle count of FIG. 13A.
Figures 14A, 14B:
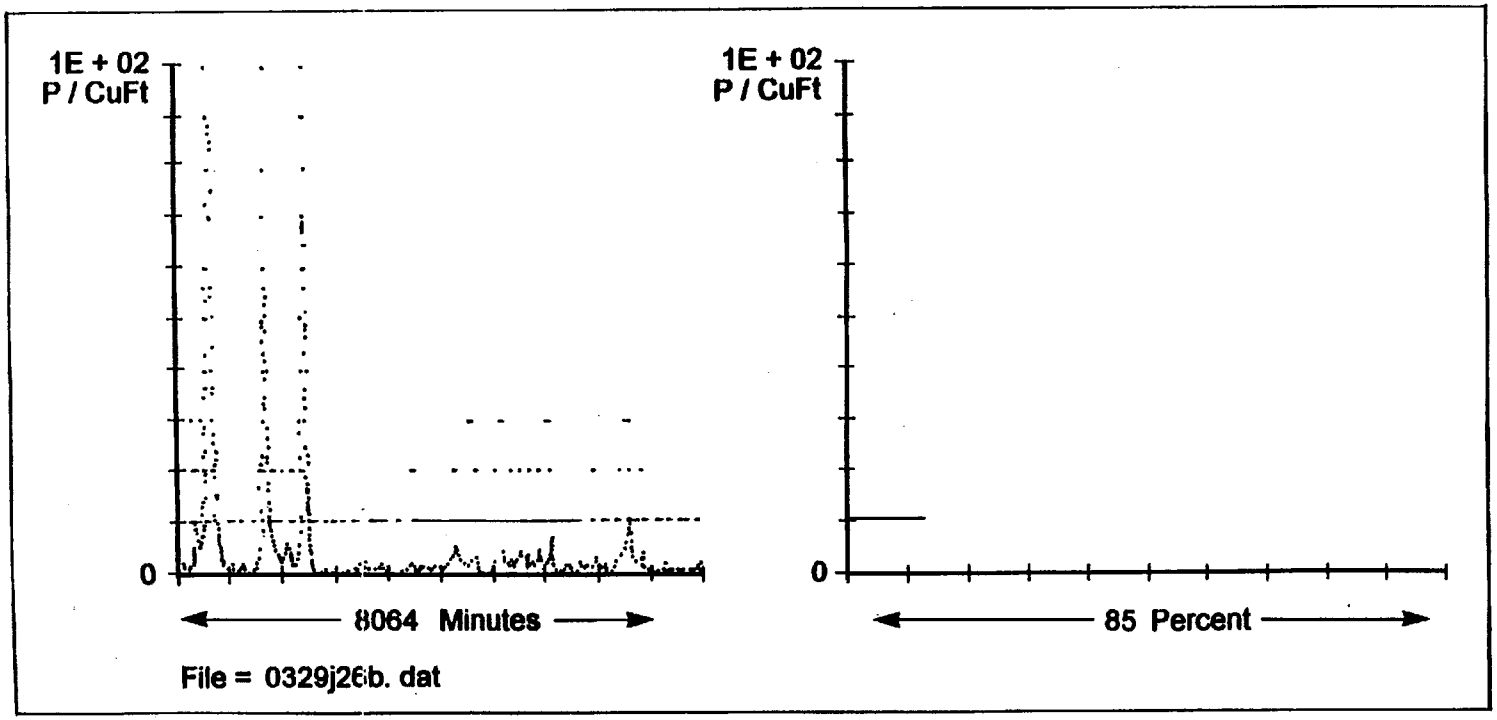
FIG. 14A is also a graph of a continuation of the test of FIG. 12.
FIG. 14B is a graph of the percentage distribution of the particle count of FIG. 14A.

FIG. 13 and 14 are continuations of the test started in FIG. 12. These graphs show the coated points have good long term stability in the particle counts. The combined average for FIGS. 12–14 is 2.5 particles per cubic foot over a 20 day period in the chamber.

Figures 15A, 15B:
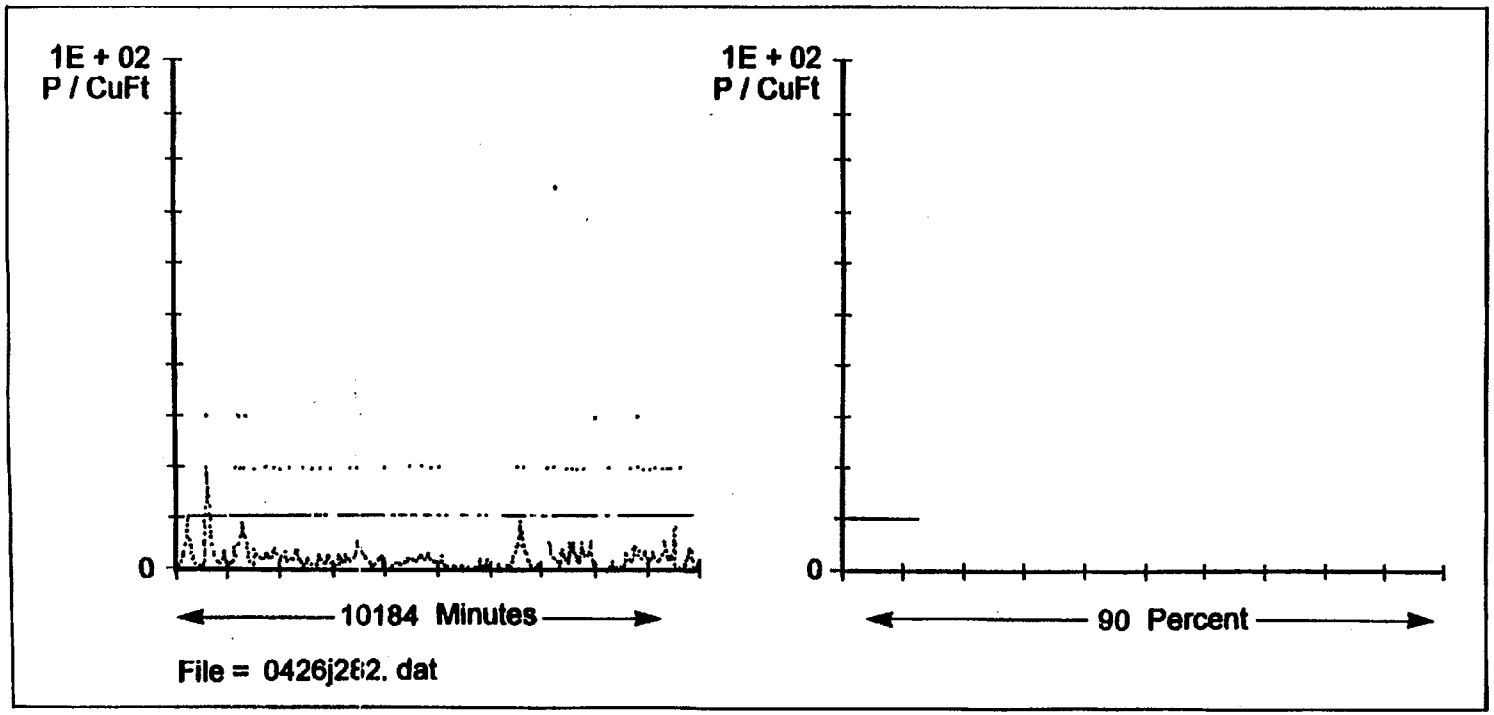
FIG. 15A is a graph of a Ti tip having a 47 micron silicon coating in a flow through box text.
FIG. 15B is a graph of the percentage distribution of the particle count of FIG. 15A.

FIG. 15 is a graph of Ti with 47 micron Si coating in a flow-through box test. This experiment demonstrated that the silicon coated emitters give low particle counts under conditions simulating a cleanroom. The average was 1.7 particles per cubic foot over a 6 day period.

One important aspect of silicon coating concerns what happens to the ionizing properties if the silicon coating fails? Prolonged treatment (ca. 20–30 minute) of the coated points in a commercial ultrasonic cleaning device partially removes the Si coating and causes the formation of pits in the coated surface. Subsequent Ti tips were coated with 90 microns of Si and ultrasonically cleaned for 20 minutes. The cleaning removed about half of the thickness of the coating, leaving about 45 microns of Si, but the remaining material was pitted down to the base metal in some areas. These data are shown in FIGS. 16, 17, and 18.

Figures 16A, 16B:
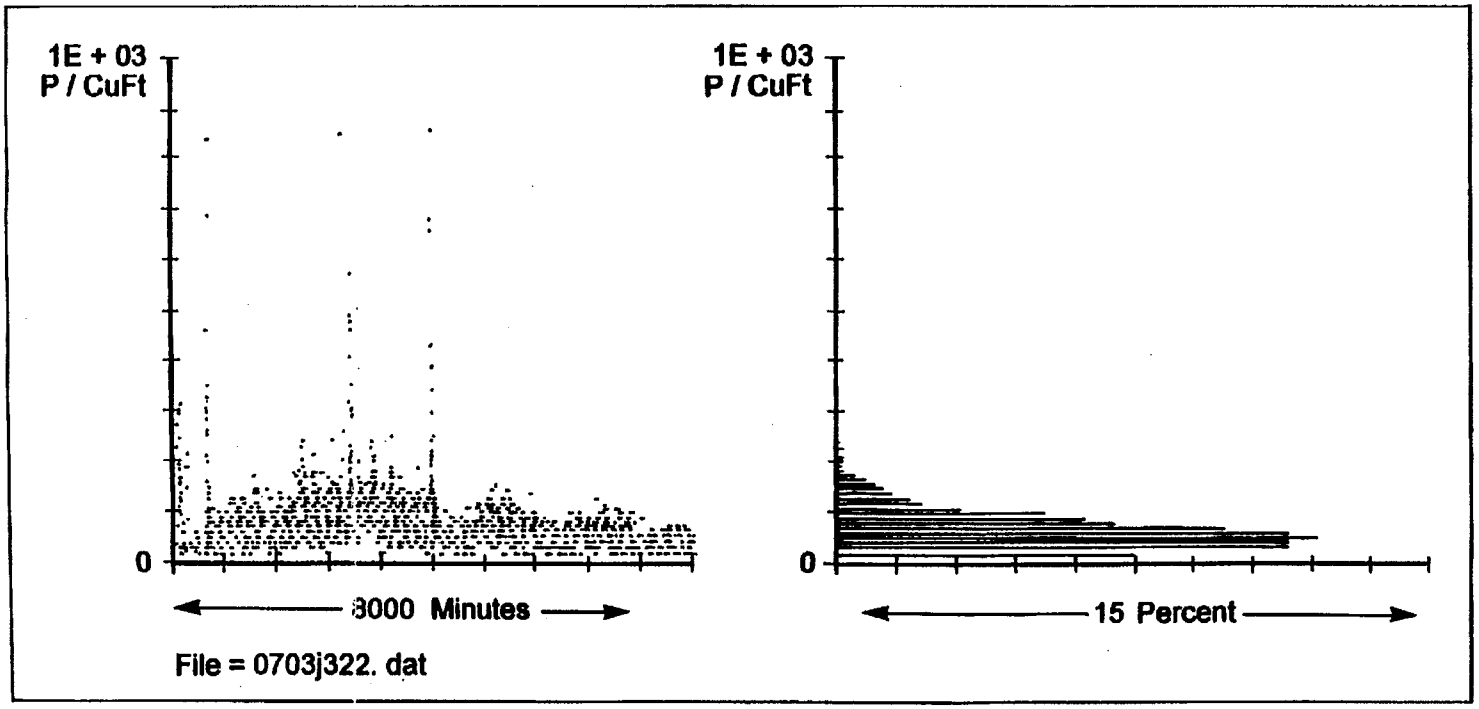
FIG. 16A is a graph of the static box test of a Ti tip coated with silicon after ultrasonic treatment.
FIG. 16B is a graph of the percentage distribution of the particle count of FIG. 16A.

FIG. 16 is a static box test of Ti coated with Si after ultrasonic treatment. This test produced noticeably higher particle counts with an average count of 59 particles per cubic foot over about 5 days.

Figures 17A, 17B:
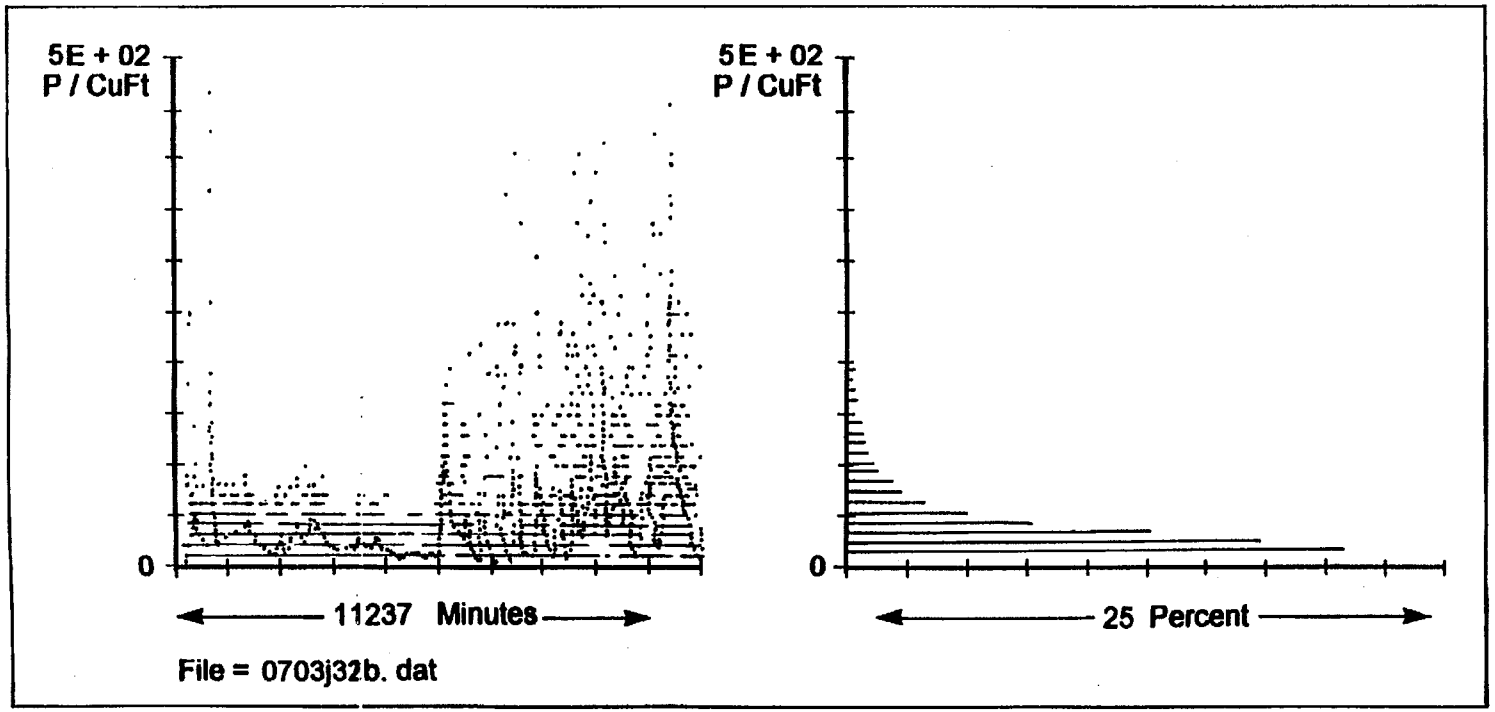
FIG. 17A is a graph of the continuation of the test of FIG. 16.
FIG. 17B is a graph of the percentage distribution of the particle count of FIG. 17A.

FIG. 17 is a continuation of the test in FIG. 10. The particle counts are still higher than untreated points, averaging 35 particles per cubic foot over about 7 days.

Figures 18A, 18B:
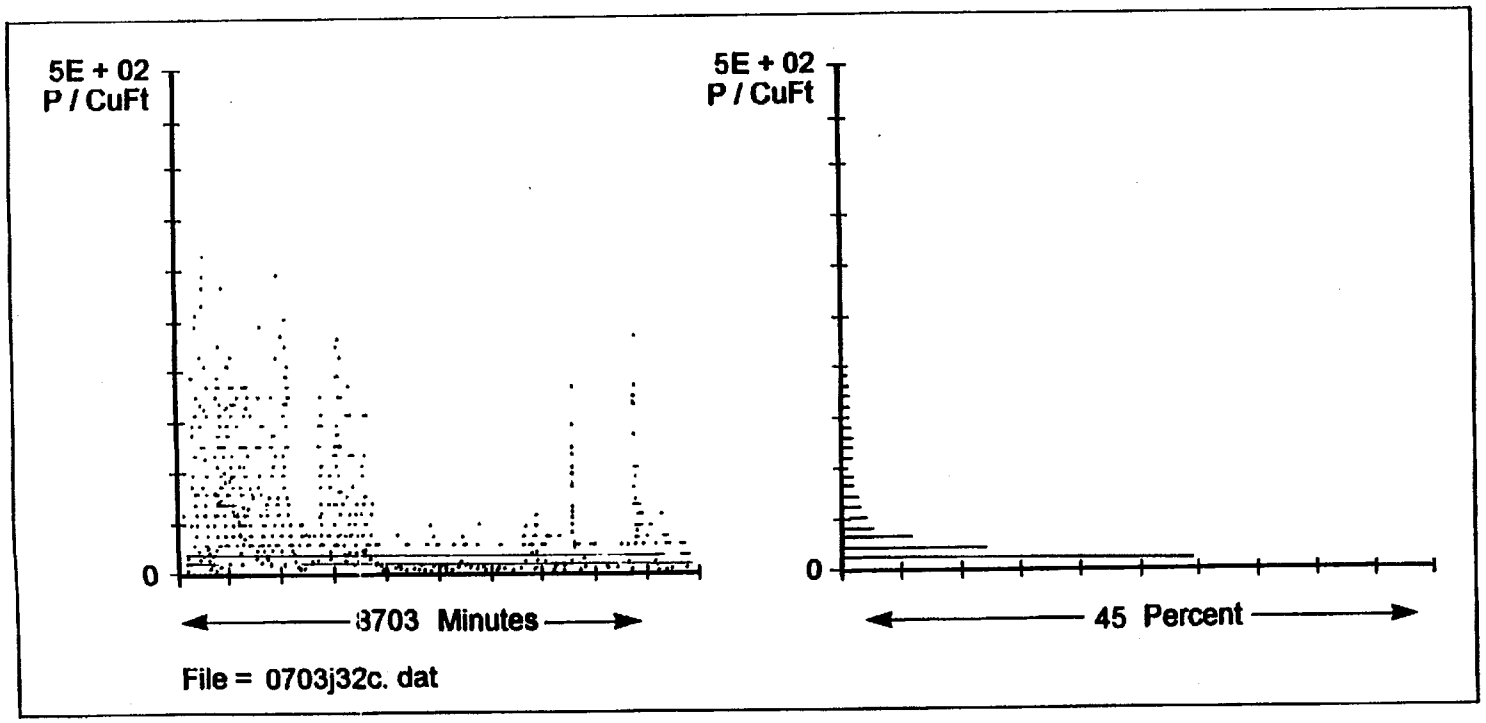
FIG. 18A is a graph of the continuation of the test of FIG. 17.
FIG. 18B is a graph of the percentage distribution of the particle count of FIG. 18A.

FIG. 18 is a continuation of the static box test in FIG. 17. The particle counts are still elevated over untreated points. The average is 20 particles per cubic foot.

The results described herein regarding silicon coating are summarized as follows:

1. Ti coated with Si is an excellent Class 1 emitter material. The coating appears to provide enhanced performance over plain Ti points, reducing particle emissions to the 1 to 10 per cubic foot range in a static box.

2. Coating Ti with Pt, a non-class 1 material, produces results similar to earlier tests of Pt wire. Platinum coated Ti points are not suitable as a class 1 emitter tip.

3. Damage of pitting of the coating caused by ultrasonic cleaning compromised the enhanced performance of the coating. The results obtained with ultrasonically treated points are similar to previous tests of pure Ti needle points. Thus, although the advantage of the coating is eventually lost during use, the particle counts are still sufficiently low to meet class 1 conditions for a useful time period.

In one embodiment, a less pure silicon emitter tip is coated with 1 to 1000 microns of pure silicon thus importing the advantages of the silicon coating.

Titanium (or Iridium) Coated Metal Emitter Tips

In another embodiment, the present invention discloses a method to coat (or plate) a second metal or metal alloy emitter tip as described herein with titanium. The plating of titanium (or iridium) is conventional in this art, or preferably can be formed using an electron beam under contract by the commercially available process of Electron Beam Vacuum Coatings, Inc. of Berkeley, Calif. These titanium coated metal tips then function as emitter tips having the desirable properties of a titanium tip producing and maintaining class 1 clean room environmental conditions. Preferably the titanium or iridium coating is between about 0.5 and 100 microns in thickness, more preferably between about 0.5 and 50 microns, especially between about 0.5 and 30 microns.

In a preferred embodiment of the present invention, a silicon emitter tip is very useful. The silicon is available from a number of commercial sources, and has a 99.99+ percent purity. In some instances, the basic silicon material is doped with a small amount of dopant selected from phosphorus ion, boron ion or antimony. The silicon precursor article is commercially available, for instance, from Silicon Casting, Inc., 2616 Mercantile, Rancho Cordova, Calif. 95742 as a silicon blank, single 1-0-0, transmitting grade.

Figure 19:
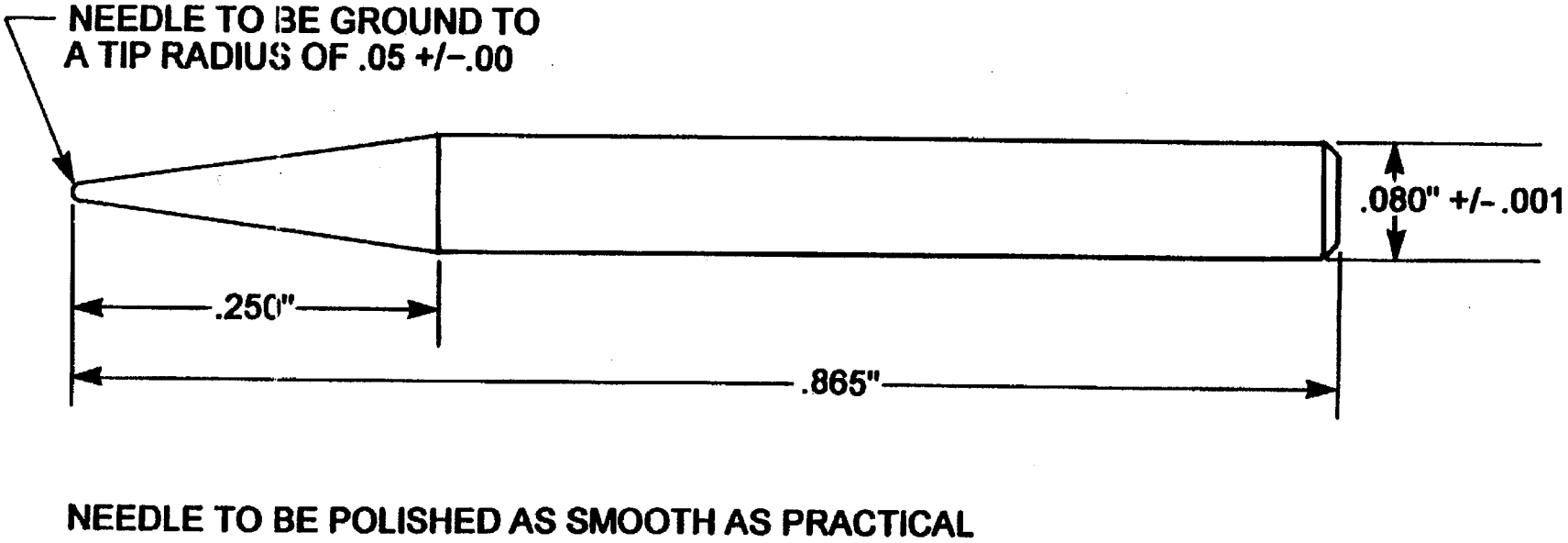
FIG. 19 is a drawing of the shape of the silicon ion emitter tip and also showns useful preferred dimensions.

The silicon article is then cut using conventional methods in the form of an emitter tip having the general and preferably the specific shape (cylindrical/conical) shown in FIG. 19.

The cutting is conventional in the art and can be performed under contract by Micro Precision Co. of 23322 "E" Madero Road, Mission Viejo, Calif. 92691.

The conical needle tip is polished to a smooth surface by using a diamond cutting wheel which is shaped so that it can form the tip and the radius.

The polishing also can be performed by Micro Precision Co.

The polished silicon emitter tip is then further processed by treatment with a mixed acid solution. Usually a mixture of concentrated nitric acid (70% strength), concentrated hydrofluoric acid (49% strength) and acetic acid, glacial, are carefully combined in about a 6/1/1 ratio (w/w/w). This mixed acid solution is Known in the semiconductor industry to clean silicon and is described as a mixed acid etch (MAE) solution. The silicon ion emitter tip is contacted with the mixture of acids for between about 0.5 and 10 min, preferably about 2 min at between about ambient temperature and 50° C., preferably 25° C.

The contact with mixed acid does have some health and safety and environmental concerns. It can be performed under closely controlled conditions, or under contract by Epitaxy, Inc., 555 Aldo Avenue, Santa Clara, Calif. 95054.

After the contact with acid, the emitter tip is washed at least one time with sufficient purified water (distilled or deionized) to remove the residual acid and then dried under ambient conditions.

Figures 20A, 20B:
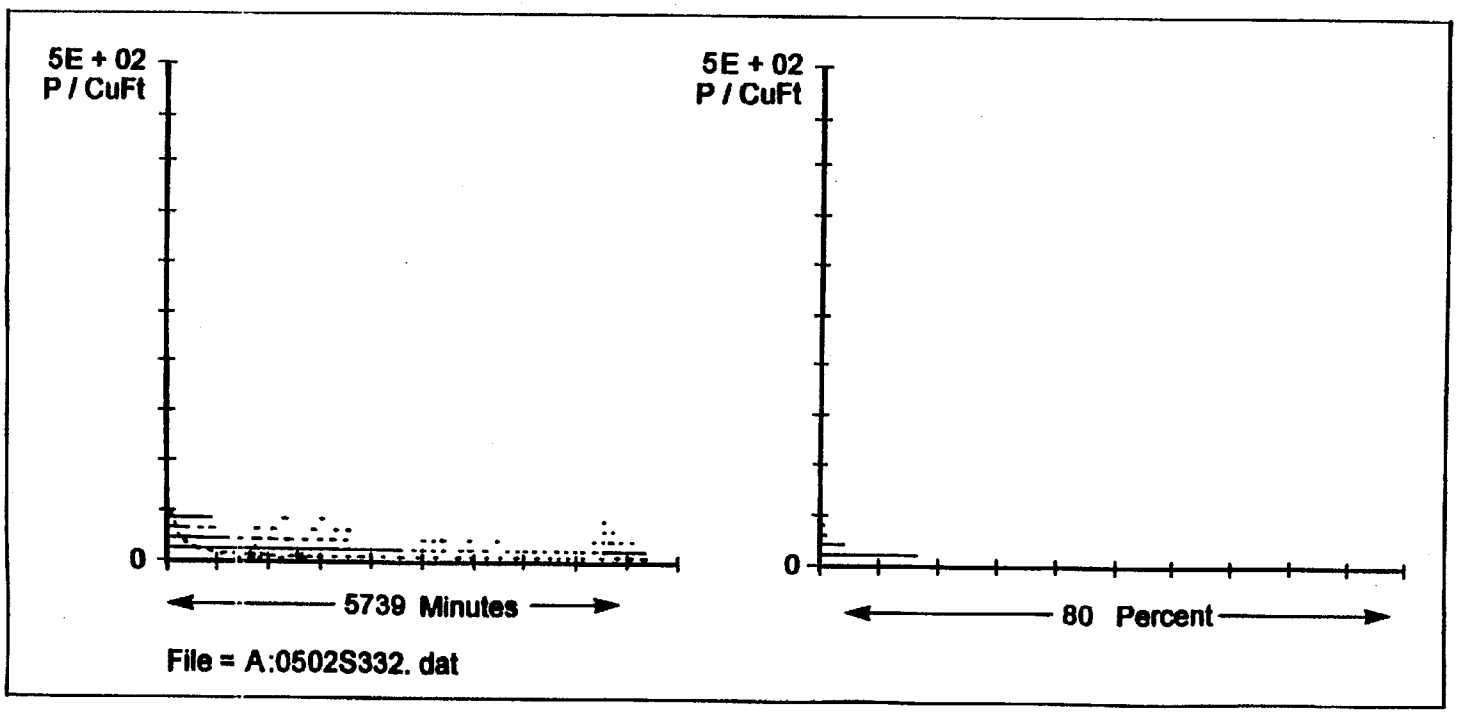
FIG. 20A is a graph of a test (static or dynamic) of the Silicon tip showing particle count.
FIG. 20B is a graph of the percentage distribution of the particle count of FIG. 20A.
Figures 21A, 21B:
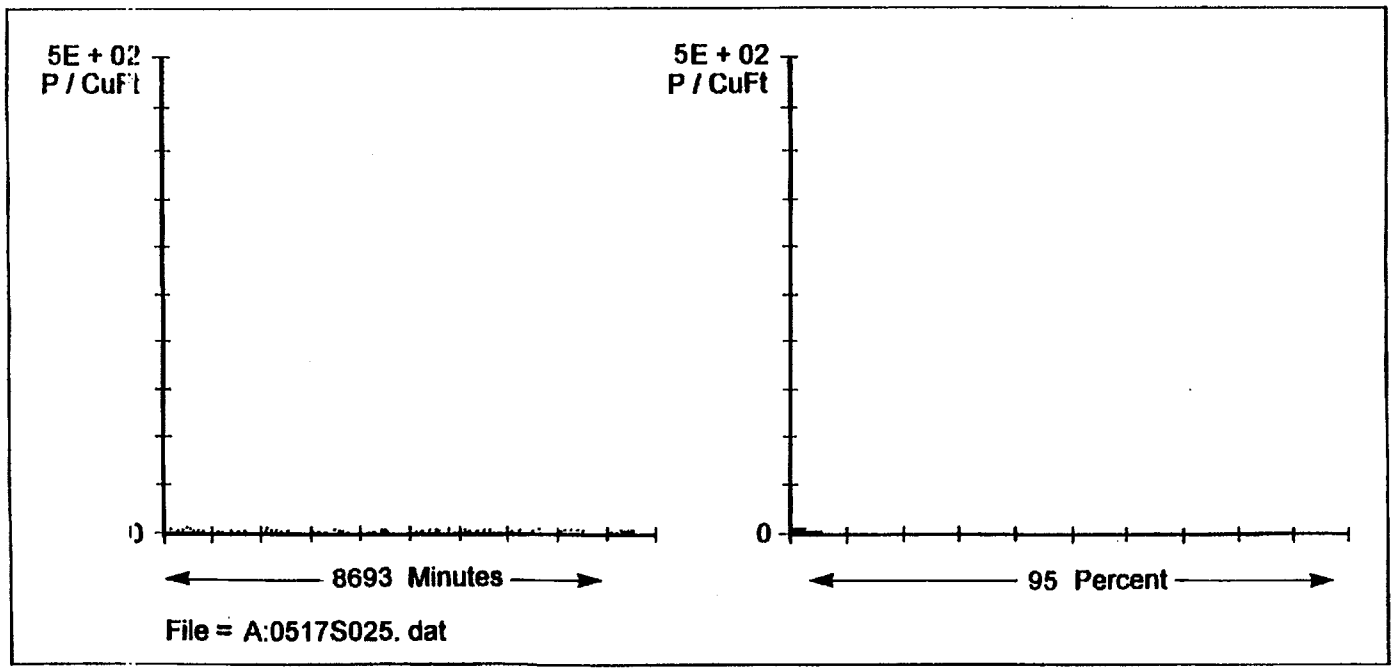
FIGS. 21A and 21B are related to FIG. 20A & 20B.
Figures 22A, 22B:
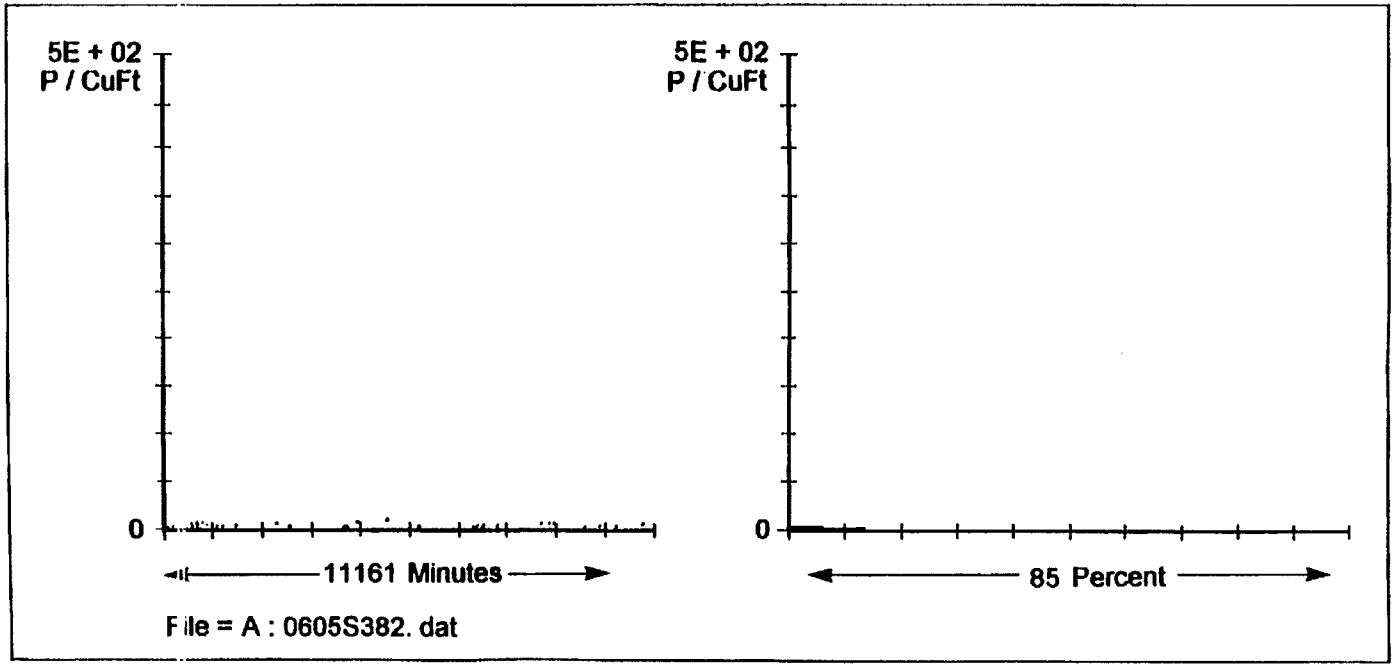
FIGS. 22A and 22B are related to FIG. 20A,20B 21A &21B.

This silicon ion emitter is subjected to ion emission conditions as described herein of 50,000 to 500,000 ions per cc. The resulting pattern is shown as FIG. 20A. FIG. 20B is a graph of the percentage distribution of the particle count of FIG. 20A. The silicon emitter tip is comparable or superior to the other ion emitter tips described herein (metal or metal-silicon coated emitter tip).

Additional embodiments are listed below:

(A) An ionization system, for ionizing the molecules of a gas which concurrently introduces quantities of particles into air, said ionization system consisting of an emitter system comprising at least one emitter point and a high voltage power supply, wherein said particles have a count mean diameter of 0.5 microns or smaller and one particle or less per cubic foot of about 0.5 micron diameter is present in a static environment or in a flowing air environment.

(B) The ionization system of (A) wherein at least one emitter tip is selected from silicon or from metals comprising zirconium, titanium, molybdenum, tantalum, rhenium, iridium or alloys thereof.

(C) The ionization system of (B) wherein the metal present in the at least one emitter tip is zirconium, is independently selected from silicon or from metals selected from titanium, molybdenum, tantalum or rhenium, wherein each metal in each emitter tip is present in about 99 percent by weight or greater.

(D) The ionization system of (C) wherein the emitter tip comprises zirconium.

(E) The ionization system of (C) wherein the emitter tip comprises titanium.

(F) The ionization system of (C) wherein the emitter tip comprises molybdenum.

(G) The ionization system of (C) wherein the emitter tip comprises tantalum.

(H) The ionization system of (C) wherein the emitter tip comprises rhenium.

(I) The ionization system of (A) wherein at least one emitter tip is independently selected from from silicon or metal alloys comprising zirconium and rhenium, titanium and rhenium, molybdenum and rhenium, tantalum and rhenium or tungsten and titanium.

(J) The ionization system of (I) wherein in each metal alloy zirconium, titanium, molybdenum, tantalum are present in at least 65 percent by weight.

(K) The ionization system of (J) wherein in each metal alloy zirconium, titanium, molybdenum, tantalum are present in at least 70 percent by weight and rhenium in each alloy is present in between about 1 and 30 percent by weight.

(L) The ionization system of (I) wherein the metal alloy is zirconium and rhenium.

(M) The ionization system of (I) wherein the metal alloy is titanium and rhenium.

(N) The ionization system of (I) wherein the metal alloy is molybdenum and rhenium.

(O) The ionization system of (I) wherein the metal alloy is tantalum and rhenium.

(P) An ion emitter tip material which limits the production of particles having a count mean diameter of 0.5 microns or less to a concentration of one particle or less per cubic foot of a size of about 0.1 microns at a current per emitter tip of between about 0.1 and 100 microamperes per emitter tip.

(Q) The ion emitter tip material of (P) wherein the current is about 2 microamperes per emitter tip.

(R) The ion emitter tip material of (P) wherein the material comprises metals selected from zirconium, titanium, molybdenum, tantalum, rhenium or alloys thereof.

(S) An ion emitter tip material wherein the material comprises alloys selected from zirconium and rhenium, titanium and rhenium, molybdenum and rhenium, or tantalum and rhenium wherein the rhenium in each alloy is present in between about 1 and 30 percent by weight.

(T) An improved ionization system for introducing quantities of ions which concurrently introduces particles having a count mean diameter of about 0.03 microns or less into an air current, said system comprising an ion emitter system containing at least one emitter point and a high voltage power supply to produce an ionization current of between about 0.1 and 100 microamperes.

(U) The ionization system of (I) wherein the metal alloy comprises tungsten and titanium.

(V) The ionization system of (U) wherein the metal alloy comprises titanium in up to about 70% by weight.

(W) The ionization system of (V) wherein the tungsten is present in between about 1 and 30 percent by weight.

(X) The emitter tip material of (P) wherein the material comprises a metal alloy of titanium and tungsten.

(Y) The ionization system of (A) wherein the emitter tip comprises silicon coated with silicon.

(Z) The ionization system of (A) wherein the emitter tip is a metal or metal alloy coated with silicon.

(AA) The ionization of (A) wherein the metal coating is titanium or iridium.

(BB) The ionization system of (A) wherein the silicon coating is between about 1 and 100 microns in thickness.

(CC) An ion tip material wherein the silicon or metal or metal alloy tip is coated with silicon.

(DD) An ion tip material of (CC) wherein the metal tip comprises titaniun, and the silicon coating is between about 1 and 100 microns in thickness.

(EE) The ionization system of (A) wherein the emitter tip is a metal or metal alloy coated with titanium or iridium.

(FF) The ionization system of (EE) wherein the base metal or metal alloy comprises platinum or tungsten.

(GG) The ion tip material of (CC) wherein a less pure silicon emitter tip is coated with purer silicon having useful ion emitter properties.

While only a few embodiments of the invention have been shown and described herein, it will become apparent to those skilled in the art that various modifications and changes can be made in the use of specific compositions of ion emitter tips to produce Class 1 clean room conditions without departing from the spirit and scope of the present invention. All such modifications and changes coming within the scope of the appended claims are intended to be carried out thereby.

I claim:

1. An improved ion emitter electrode for ionizing molecules of gas, the electrode consisting of silicon which is doped substantially homogeneously with a dopant.

2. The electrode of claim 1 wherein the dopant is selected from the group consisting of phosphorus, antimony and boron.

3. The electrode of claim 1 including:

(a) a cylindrical portion having selected length and diameter; and (b) a conical portion having a substantially circular portion of a proximal end of the cone disposed at one circular end of the cylindrical portion, and having a taper extending outwardly toward a point having a nominal radius of curvature.

4. The electrode of claim 3 wherein the cylindrical portion and the conical portion are integrally formed of substantially homogenous silicon.

5. A method of producing an improved ion emitter electrode comprising the steps of:

A. obtaining a silicon precursor;

B. machining the silicon precursor to form the emitter electrode having a cylindrical portion and a conical portion extending toward a tip;

C. polishing the tip;

D. contacting the tip with a mixture of concentrated nitric acid, concentrated aqueous hydrofluoric acid and glacial acetic acid;

E. washing the tip to remove the acid;

F. drying the tip; and

G. doping the silicon substantially homogeneously with a dopant.

6. The method of claim 5 wherein in step C, polishing the tip uses mechanical surface abrasives.

7. The method of claim 6 wherein in step D the tip is dried at about ambient temperature.

8. The method of claim 5 wherein the dopant is selected from the group consisting of phosphorus and boron and antimony.

9. The electrode of claim 1 wherein the silicon is approximately 99.9% pure.

10. The method of claim 5 wherein the silicon is approximately 99.9% pure.

* * * * *